US006653643B2

(12) United States Patent
Saadatmand et al.

(10) Patent No.: US 6,653,643 B2
(45) Date of Patent: Nov. 25, 2003

(54) METHOD AND APPARATUS FOR IMPROVED ION ACCELERATION IN AN ION IMPLANTATION SYSTEM

(75) Inventors: Kourosh Saadatmand, Beverly, MA (US); William F. DiVergilio, Beverly, MA (US)

(73) Assignee: Axcelis Technologies, Inc., Beverly, MA (US)

( * ) Notice: Subject to any disclaimer, the term of this patent is extended or adjusted under 35 U.S.C. 154(b) by 56 days.

(21) Appl. No.: 10/036,144

(22) Filed: Dec. 26, 2001

(65) Prior Publication Data

US 2002/0084427 A1 Jul. 4, 2002

Related U.S. Application Data

(60) Provisional application No. 60/258,579, filed on Dec. 28, 2000.

(51) Int. Cl.[7] ..... G21K 5/00
(52) U.S. Cl. ..... 250/492.21; 250/492.1
(58) Field of Search ..... 250/492.1, 492.2, 250/495.21, 492.3

(56) References Cited

U.S. PATENT DOCUMENTS 4,667,111 A * 5/1987 Glavish et al. ..... 250/492.2
4,801,847 A * 1/1989 Sakudo et al. ..... 315/5.41
5,349,196 A * 9/1994 Amemiya et al. ..... 250/492.21
5,504,341 A 4/1996 Glavish
5,801,488 A * 9/1998 Fujisawa ..... 315/5.41
5,907,158 A 5/1999 Nasser-Ghodsi et al.

OTHER PUBLICATIONS

"Radio Frequency Ion Accelerator", N. J. Barrett, Department of Electronic and Electrical Engineering, University of Surrey, guldford, Surrey, England, no date available, 9 pages.

* cited by examiner

*Primary Examiner*—John R. Lee
*Assistant Examiner*—Christopher M. Kalivoda
(74) *Attorney, Agent, or Firm*—Eschweiler & Associates, LLC

(57) ABSTRACT

A method and apparatus are disclosed for accelerating ions in an ion implantation system. An ion accelerator is provided which comprises a plurality of energizable electrodes energized by a variable frequency power source, in order to accelerate ions from an ion source. The variable frequency power source allows the ion accelerator to be adapted to accelerate a wide range of ion species to desired energy levels for implantation onto a workpiece, while reducing the cost and size of an ion implantation accelerator.

29 Claims, 15 Drawing Sheets

METHOD AND APPARATUS FOR IMPROVED ION ACCELERATION IN AN ION IMPLANTATION SYSTEM

This application claims priority to Serial No. 60/258,579 filed Dec. 28, 2000, which is entitled "Method and Apparatus for Improved Ion Acceleration in an Ion Implantation system".

FIELD OF THE INVENTION

The present invention relates generally to ion implantation systems, and more particularly to methods and apparatus for improved ion acceleration in an ion implantation system.

BACKGROUND OF THE INVENTION

In the manufacture of semiconductor devices, ion implantation is used to dope semiconductors with impurities. A high energy (HE) ion implanter is described in U.S. Pat. No. 4,667,111, assigned to the assignee of the present invention, which is hereby incorporated by reference as if fully set forth herein. HE ion implanters are used for deep implants into a substrate in creating, for example, retrograde wells. Such implanters typically perform implants at energies between at least 300 keV and 700 keV. Some HE ion implanters are capable of providing ion beams at energy levels up to 5 MeV.

Referring to FIG. 1, one implementation of high energy ion implanter 10 is illustrated, having a terminal 12, a beamline assembly 14, and an end station 16. The terminal 12 includes an ion source 20 powered by a high voltage power supply 22. The ion source 20 produces an ion beam 24, which is provided to the beamline assembly 14. The ion beam 24 is then directed toward a target wafer 30 in the end station 16. The ion beam 24 is conditioned by the beamline assembly 14, which comprises a mass analysis magnet 26 and a radio frequency (RF) linear accelerator (linac) 28. The mass analysis magnet 26 passes only ions of an appropriate charge to-mass ratio to the linac 28.

The linac 28 includes a series of accelerating stages or modules 28*a*–28*n*, each of which further accelerates ions beyond the energies they achieve from prior modules. The accelerator modules 28*a*-28*n* in the implementation of FIG. 1 are individually energized by dedicated, fixed-frequency RF amplifiers and resonator circuits (not shown). The linear accelerator modules 28*a*–28*n* in the high energy ion implanter 10 individually include an RF amplifier, a resonator, and an energizable electrode, wherein the resonators operate at a fixed frequency in order to accelerate ions of the beam 24 to energies over one million electron volts per charge state.

The accelerator 28 of FIG. 1 may be adapted to efficiently accelerate various ion species through adjustment of the relative phase between adjacent accelerator modules 28*a*–28*n*. However, the adjustments in the individual accelerator modules 28*a*–28*n* must be made carefully in order to provide for proper acceleration of ions through the entire accelerator 28. Thus, sophisticated controls and/or trial and error methodologies are commonly employed in order to tune such multi-variable accelerator systems 28 for specific acceleration energies, and for specific ion species. In addition, the provision of multiple fixed-frequency amplifiers associated with individual accelerating stages 28*a*–28*n* is costly and such dedicated amplifiers and associated resonator circuits occupy a significant amount of space in conventional ion implantation systems. Thus, there remains a need for improved ion acceleration apparatus and methodologies to facilitate low cost, simplified ion implantation systems.

SUMMARY OF THE INVENTION

The present invention is directed to an ion accelerator for use in an ion implantation system, as well as methodologies for accelerating ions in such a system, which reduce or overcome the problems and shortcomings found in conventional accelerators. In particular, an ion accelerator is provided, comprising a plurality of energizable electrodes energized by a variable frequency power source or amplifier, in order to accelerate ions from an ion source. The employment of a variable frequency power source allows the ion accelerator to be adapted to accelerate a wide range of ion species to desired energy levels for implantation onto a workpiece. The single power source reduces the cost and complexity of the ion accelerator and associated controls compared with conventional accelerators, and additionally reduces the size thereof. The invention further includes methodologies for accelerating ions in an ion implantation system, which may be employed to achieve performance and cost advantages over conventional methodologies.

One aspect of the invention provides an ion accelerator for accelerating ions traveling along a path in an ion implantation system. The accelerator includes one or more accelerating stages, each stage having one or more energizable electrodes and a variable frequency RF system, such as a variable frequency power source and an associated variable frequency resonator. The accelerator stage or stages may comprise constant potential (e.g., grounded) electrodes interleaved between the energizable electrodes, where the RF system energizes all the energizable electrodes in phase with one another. Alternatively, alternating energizable electrodes can be connected to a first RF system terminal, with the remaining electrodes connected to a second terminal, for instance, such that adjacent energizable electrodes are energized 180 degrees out of phase.

The accelerator may also comprise a variable frequency buncher stage located upstream of the initial accelerating stage to provide bunched ions thereto. Reliability in such an implementation may be improved in accordance with the present invention, since only two RF systems are required (e.g., such as a high power RF system for the accelerating stage and a lower power RF system for the buncher stage). Moreover, the reduced number of independent RF systems (e.g. power sources and resonators) simplifies associated control systems and may reduce the time and effort required to tune ion implantation systems. Where multiple accelerating stages are used, or where a buncher stage is provided, the stages are operable at the same frequency or one stage may be operated at a harmonic of the frequency of another stage. In addition, the relative phasing between multiple stages, and/or between accelerating stages and a buncher stage may be controlled at a fixed relationship, or may be adjustable.

Because a single variable frequency power source is used to energize a series of energizable electrodes, the system cost and size are significantly reduced compared with conventional ion accelerators having an RF system for each energizable electrode. In addition, the invention provides an accelerator which is much easier to tune and control, particularly where an ion implantation system is used to implant different ion species at different energy levels. Thus, the system complexity is reduced along with the complexity of associated controls, whereby reduced setup and/or tuning time is achieved. In addition, where previous systems may have been limited in their ability to support a wide range of ion species and energy levels (e.g., due to the complexity involved in tuning the individual resonators and fixed frequency amplifiers), the present invention provides an accelerator with fewer system variables, which is adaptable to support a wide range of ion species and energy levels.

The variable frequency power source, moreover, may be adjustable to provide RF energy to the energizable electrodes in a frequency range appropriate to support commonly used ion species and acceleration energy levels. For instance, the power source may be adjustable in a range of from about 1 to 10 times a given frequency, such as from about 4 MHz to about 40 MHz. The invention comprises any number of such energizable electrodes in a given accelerating stage. The invention may thus provide significant cost and space savings over existing high energy ion implantation systems and linear accelerators.

Another aspect of the invention provides an ion implantation system comprising an ion accelerator as described above having one or more energizable electrodes energized with a variable frequency power source, as well as an ion source providing an ion beam to the accelerator, an end station adapted to position a workpiece so that accelerated ions impact the workpiece, and a controller operative to control the accelerator and/or other system components. The implantation system may further comprise a dedicated ion buncher located upstream of the initial accelerating stage. Yet another aspect of the invention involves a method of accelerating ions in an ion implantation system. The method comprises providing a plurality of energizable electrodes spaced from one another in series along a path, and applying an alternating potential of a controlled frequency and amplitude to the plurality of energizable electrodes using a variable frequency RF power source in order to create alternating electric fields along the path, whereby ions are accelerated along the path.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
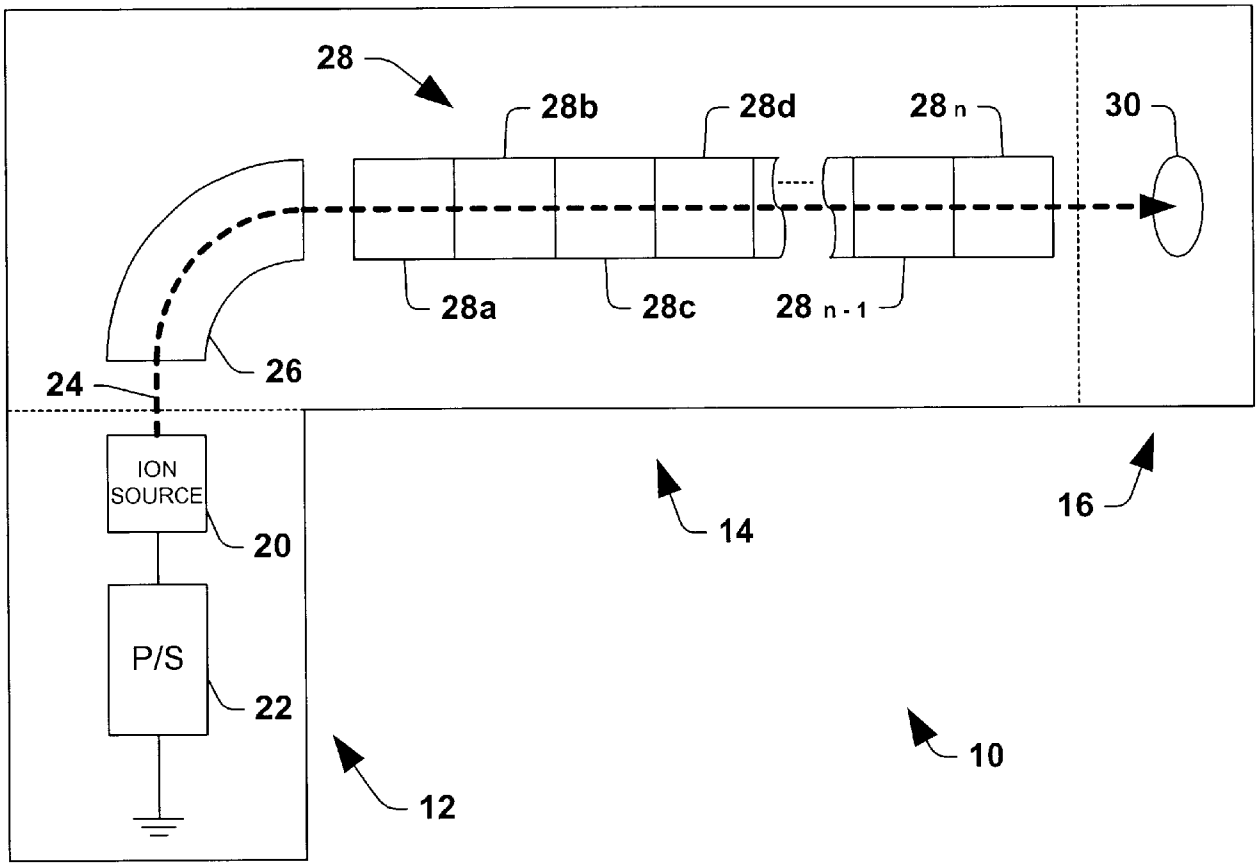
FIG. 1 (PRIOR ART)
FIG. 1 is a schematic block diagram illustrating a high energy ion implanter having an ion accelerator.

The present invention will now be described with reference to the drawings wherein like reference numerals are used to refer to like elements throughout. The invention provides methods and apparatus for accelerating ions in an ion implantation system. An ion accelerator is provided, comprising a plurality of energizable electrodes energized by a selectively variable frequency RF system, in order to accelerate ions from an ion source. The RF system in the illustrated implementations comprises a variable frequency RF power source and an associated variable frequency resonator allowing the ion accelerator to be adapted to accelerate a wide range of ion species to desired energy levels for implantation onto a workpiece. The single adjustable power source reduces the cost and complexity of the ion accelerator and associated controls compared with conventional accelerators, as well as reducing the size thereof. The invention further includes a method for accelerating ions in an ion implantation system, which provides performance and cost advantages over conventional methodologies.

In order to provide context for various features of the invention, a brief discussion of a conventional interconnection of an RF power source, resonator, and energizable electrode in a linear accelerator module (e.g., modules 28*a*–28*n* of FIG. 1) is now provided. Referring now to FIG. 2, a conventional resonator circuit 100 is illustrated which includes an inductor coil L connected in parallel with a resistance $R_L$ and a capacitance $C_s$. An energizable electrode 108 is connected to the inductor L. The electrode 108 is mounted between two grounded electrodes 112 and 114 such that energizing the electrode 108 creates alternating electric fields in the gaps between the electrodes 108 and 112. The alternating electric fields, in turn, accelerate particles in the ion beam 110 in a controlled fashion. The capacitance $C_s$represents the stray capacitance of the energizable electrode 108, and the resistance $R_L$ represents the losses associated with the resonant circuit comprising the inductor L and the capacitance $C_s$.

Figure 2:
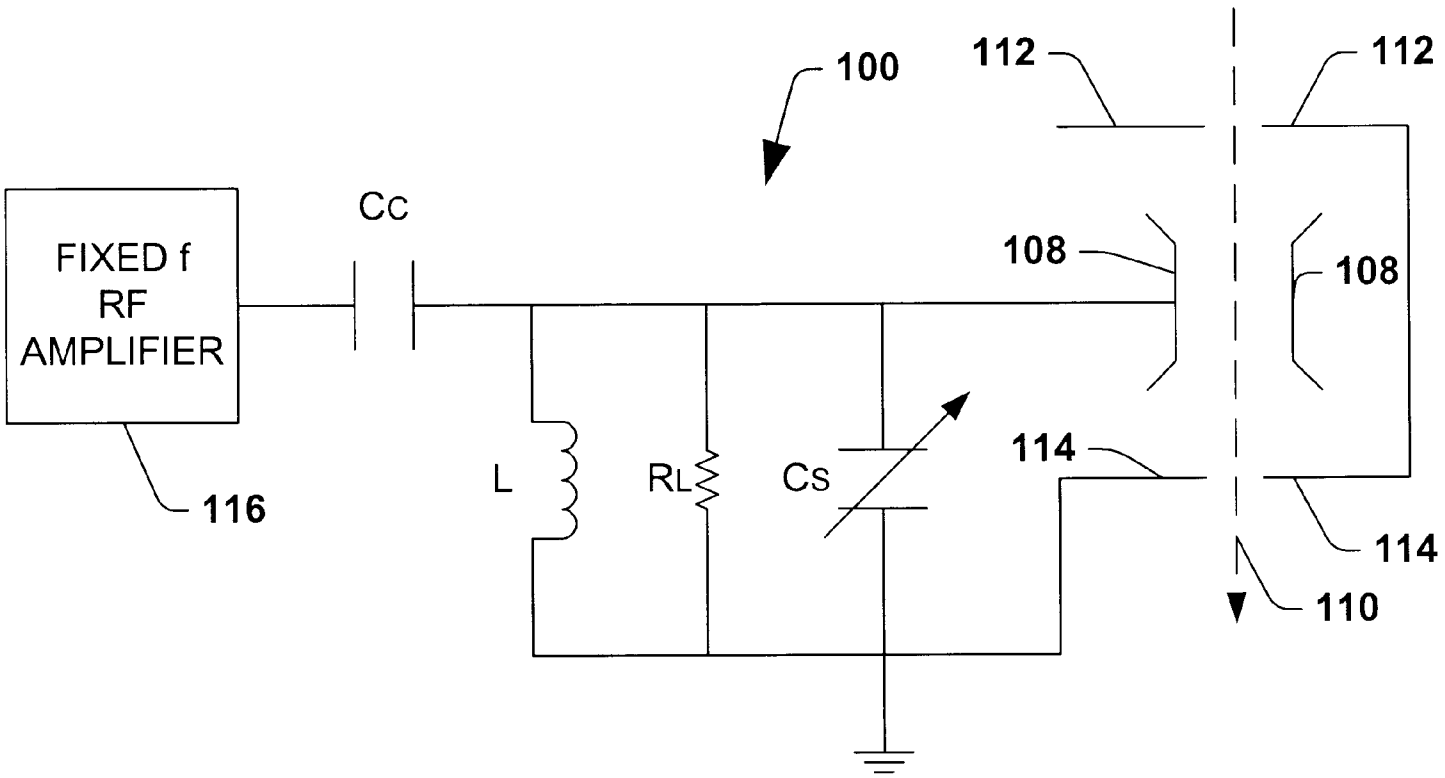
FIG. 2 (PRIOR ART)
FIG. 2 is a schematic diagram illustrating a conventional ion accelerator module having a dedicated fixed frequency RF amplifier.

The values for the capacitance $C_s$ and the inductor coil L are selected to form a low loss (high Q) resonant or "tank" circuit 100, wherein each accelerator module in a linear accelerator system of the type shown in FIG. 1 resonates at the same frequency. The capacitance $C_s$ is adjustable in a limited range to allow tuning of the resonator to resonate at the fixed frequency of a power source 116, such as to compensate for temperature effects on the tank circuit 100. The radio frequency (RF) power source 116 is capacitively coupled to a high voltage end of the coil L via a capacitor $C_c$ in order to energize the resonator circuit 100 with RF energy at a certain fixed frequency. Such a fixed-frequency amplifier 116 is associated with each resonator circuit 100 in the ion accelerator system of FIG. 1. As described above, the single energizable electrode-single amplifier configuration in the system of FIG. 1 provides adjustability if desired with respect to the relative phase in successive accelerating stages, but does not allow variation in the frequency of the alternating electric field in the accelerating gaps. Furthermore, the single energizable electrode-single amplifier configuration requires significant system space, extra components, and increased system and control complexity.

Figure 3:
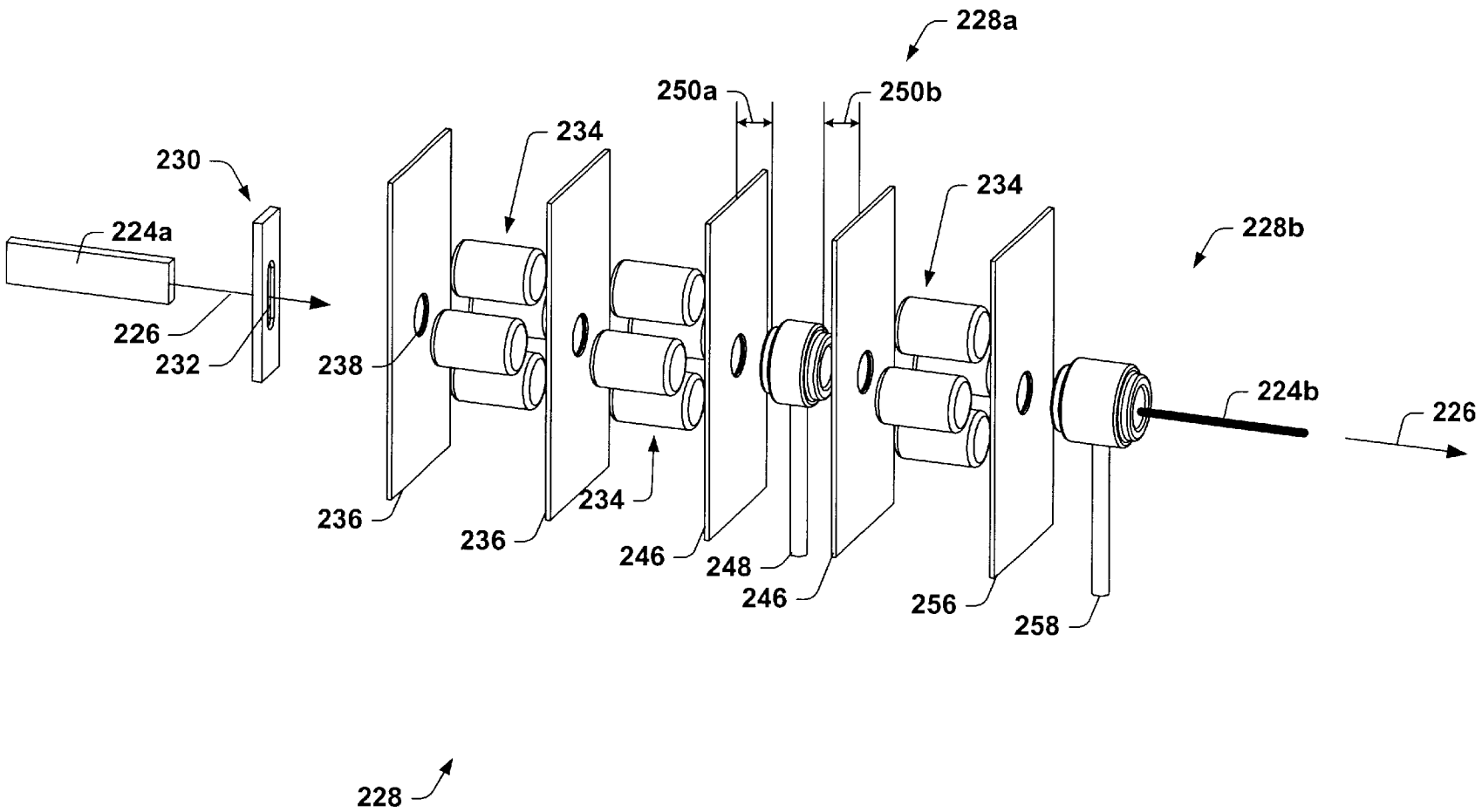
FIG. 3 (PRIOR ART)
FIG. 3 is a perspective view of a portion of an ion accelerator having single electrode accelerating stage.

Referring now to FIG. 3, a portion of an ion accelerator 228 is illustrated, having single energizable electrode accelerating stages 228*a* through 228*n* (e.g., where n is an integer), where two such stages, 228*a* and 228*b* are illustrated. A DC ion beam 224*a* is provided to the accelerator 228 (e.g., from an upstream mass analyzer magnet, not shown), along a beam path 226. The DC beam 224*a* is passed through an entrance aperture 230 having an opening 232 along the path 226. The beam 224*a* is formed into a generally cylindrical transverse profile (not shown) via two electrostatic quadrupole devices 234 and corresponding grounded electrodes 236, wherein the grounded electrodes 236 each comprise a cylindrical aperture 238 located along the path 226. Each of the accelerating stages or modules 228*n* further accelerates ions from the beam 224 beyond the energies they achieve from prior modules.

The accelerating stage 228*a* comprises a pair of grounded electrodes 246 located before and after an energizable electrode 248 along the path 226, where the energizable electrode 248 may be energized by an associated RF energy source or amplifier and resonator (not shown) in order to achieve acceleration of ions within the beam 224*a* along the beam path 226. The grounded electrodes 246 are generally equally spaced from the energizable electrode 248 to provide first and second generally equal accelerating gap lengths 250*a* and 250*b* therebetween. Similarly, the second accelerating stage 228*b* comprises a first grounded electrode 256 located along the path 226 upstream of a second energizable electrode 258 and a second grounded electrode (not shown) downstream of the energizable electrode 258 along the path 226.

Focusing electrostatic quadrupoles 234 may be provided along the path 226 between successive accelerating stages (e.g., between first and second accelerating stages 228*a* and 228*b*) in order to provide radial focusing of the beam 224 as it travels through successive accelerating stages 228*n*. The accelerator 228 may comprise further accelerating stages or modules (not shown), whereby an accelerated ion beam 224*b* may be generated at an energy level higher than that of the DC beam 224*a* provided to the accelerator 228. The resulting accelerated beam 224*b*, moreover, may attain a generally cylindrical transverse profile as a result of the accelerating stages 228*n* and the quadrupoles 234 along the beam path 226.

Figure 4:
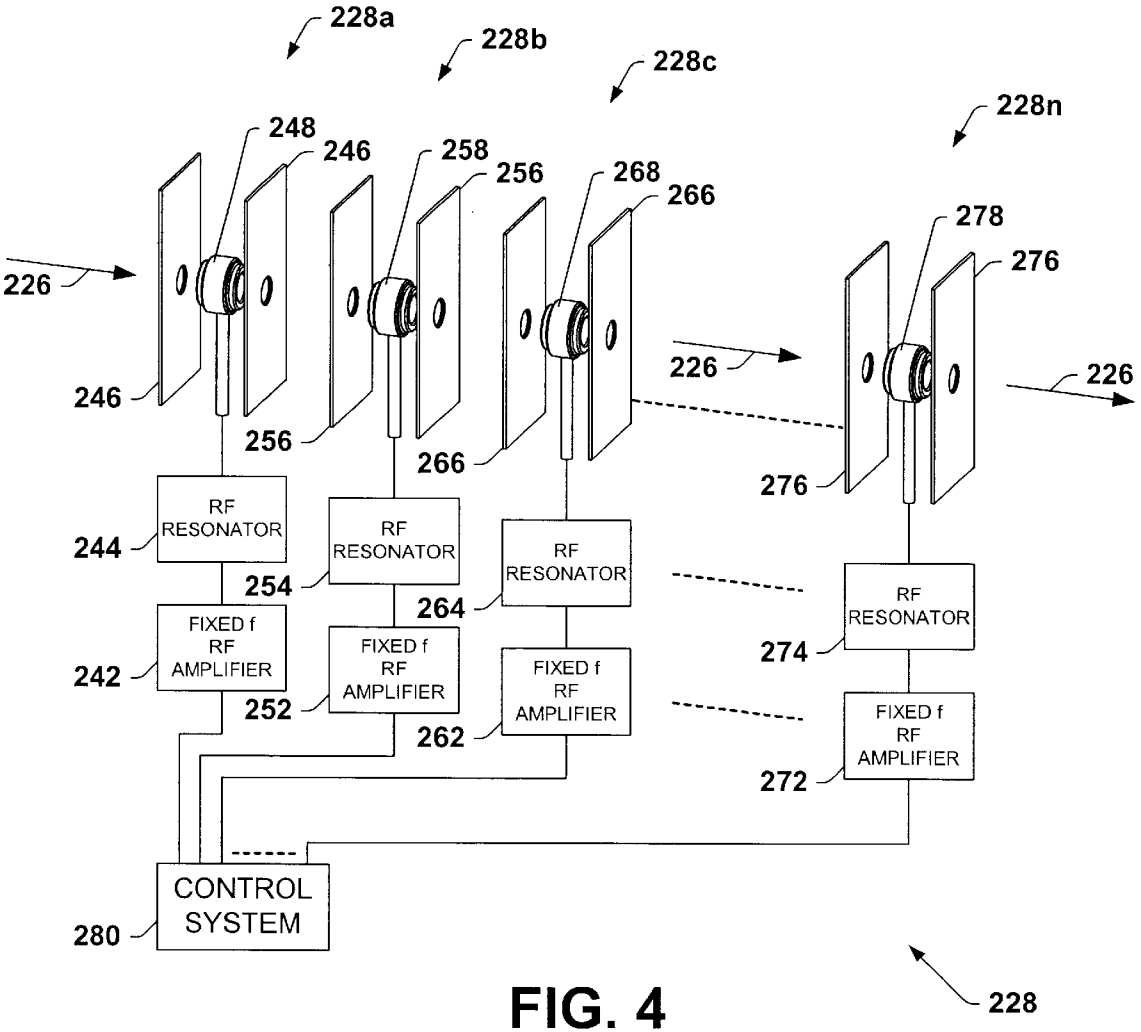
FIG. 4 (PRIOR ART)
FIG. 4 is a perspective view of another portion of the ion accelerator of FIG. 3, illustrating several single electrode, double gap, accelerating stages with a plurality of dedicated fixed frequency RF amplifiers.

Referring also to FIG. 4, a perspective view of another portion of the ion accelerator 228 is illustrated having several single energizable electrode, double gap, accelerating stages 228*a* through 228*n*, four of which (e.g., stages 228*a*, 228*b*, 228*c*, and 228*n*) are illustrated, wherein intervening radial focusing devices are omitted for the sake of clarity. The third and nth accelerating stages 228*c* and 228*n* include energizable electrodes 268 and 278, as well as grounded electrodes 266 and 276, respectively. The single energizable electrode, double gap accelerating stages 228*a*, 228*b*, 228*c*, and 228*n*, each comprise an associated, fixed-frequency, RF amplifier 242, 252, 262, and 272 and RF resonator 244, 254, 264, and 274, respectively.

The amplifiers 242, 252, 262, and 272 provide fixed-frequency power to the electrodes 248, 258, 268, and 278 via the resonators 244, 254, 264, and 274 in a controlled fashion, for example, according to control signals from a control system 280. In this regard, the control system 280 may provide for control of the relative phasing and amplitude of the power supplied to the energizable electrodes 248, 258, 268, and 278, for example, by adjusting the amplitudes via the amplifiers 242, 252, 262, and 272 and the phases via the resonators 244, 254, 264, and 274. It will be noted at this point that while adjustment of the various amplitudes and relative phasing of the RF energy applied to the energizable electrodes 248, 258, 268, and 278 allows the ion accelerator 228 to be tuned or adapted to accelerate a variety of ion species at a variety of energy levels, the accelerator 228 includes a large number of components, many of which need to be properly tuned or adjusted in order to achieve an overall tuned system. Thus, while the accelerator 228 is flexible, the flexibility adds cost and complexity to the accelerator 228 and an ion implantation system employing the accelerator 228.

Figure 5:
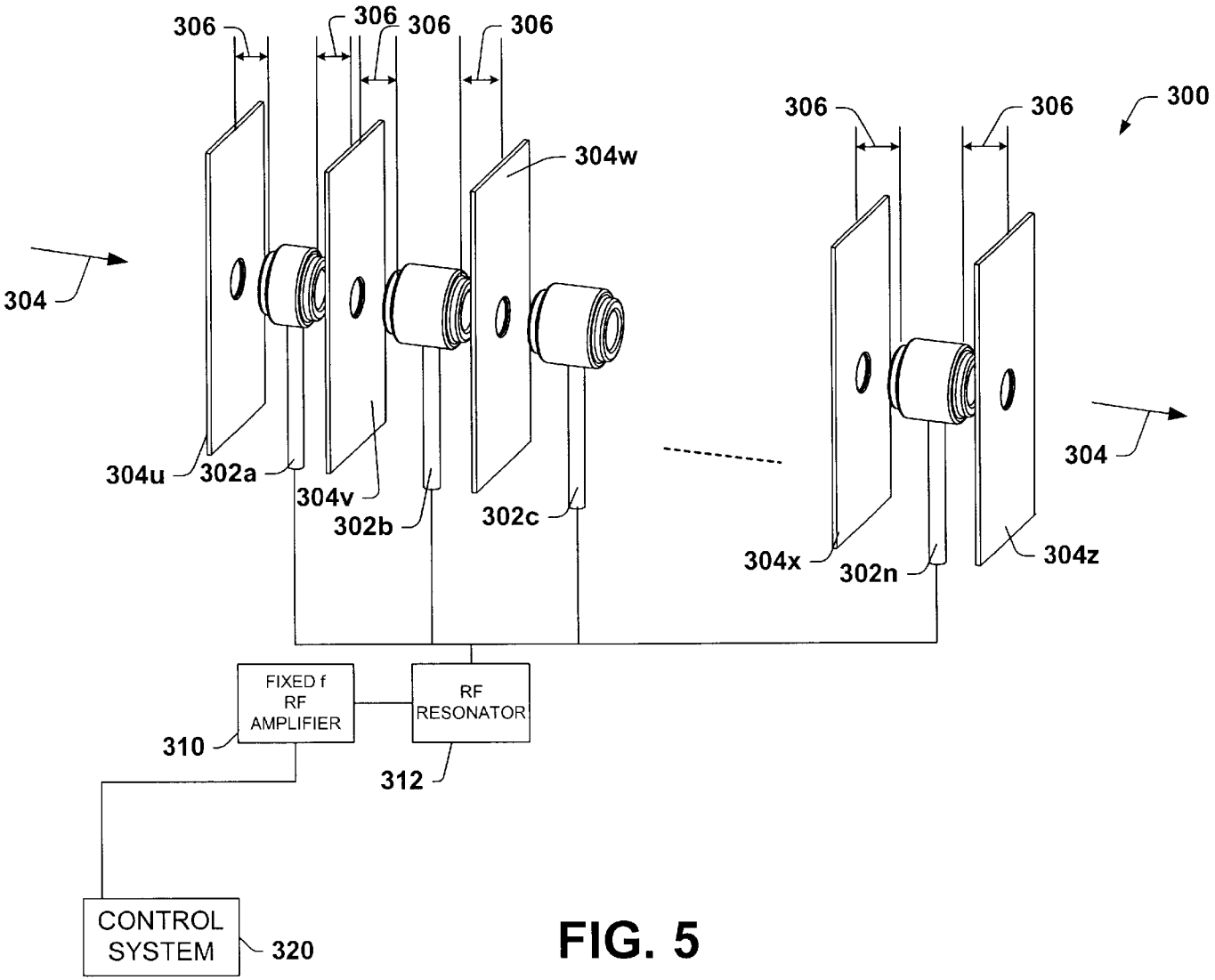
FIG. 5 is a perspective view of a portion of an exemplary ion accelerator having a multiple electrode, multiple gap accelerator having a plurality of dedicated fixed frequency RF amplifiers.

Referring briefly to FIG. 5, a multiple energizable electrode ion accelerator 300 may be provided in accordance with one aspect of the invention, in order to reduce the size and cost of ion implantation systems. The exemplary accelerator 300 comprises a plurality of n energizable electrodes 302*a*, 302*b*, 302*c*, through 302*n* (wherein n is an integer) positioned along an ion beam path 304. Constant potential (e.g., grounded) electrodes 304*u*, 304*v*, 304*w*, 304*x*, and 304*z* are positioned before and after the energizable electrodes so as to create a plurality of generally equal accelerating gaps 306 between adjacent energizable electrodes 302*a*–302*n* and constant potential electrodes 304*u*–304*z*. The electrodes 302*a*, 302*b*, 302*c*, through 302*n* are energized by a fixed frequency RF amplifier 310 as well as resonator 312 according to a control system 320. Although the accelerator 300 may provide some measure of cost and size reduction through employment of multiple energizable electrodes (e.g., 302*a*, 302*b*, 302*c*, through 302*n*) and more than two accelerating gaps 306, the range of adjustment with respect to various ion species and energy levels may be significantly less than that of the accelerator 228.

Figure 6:
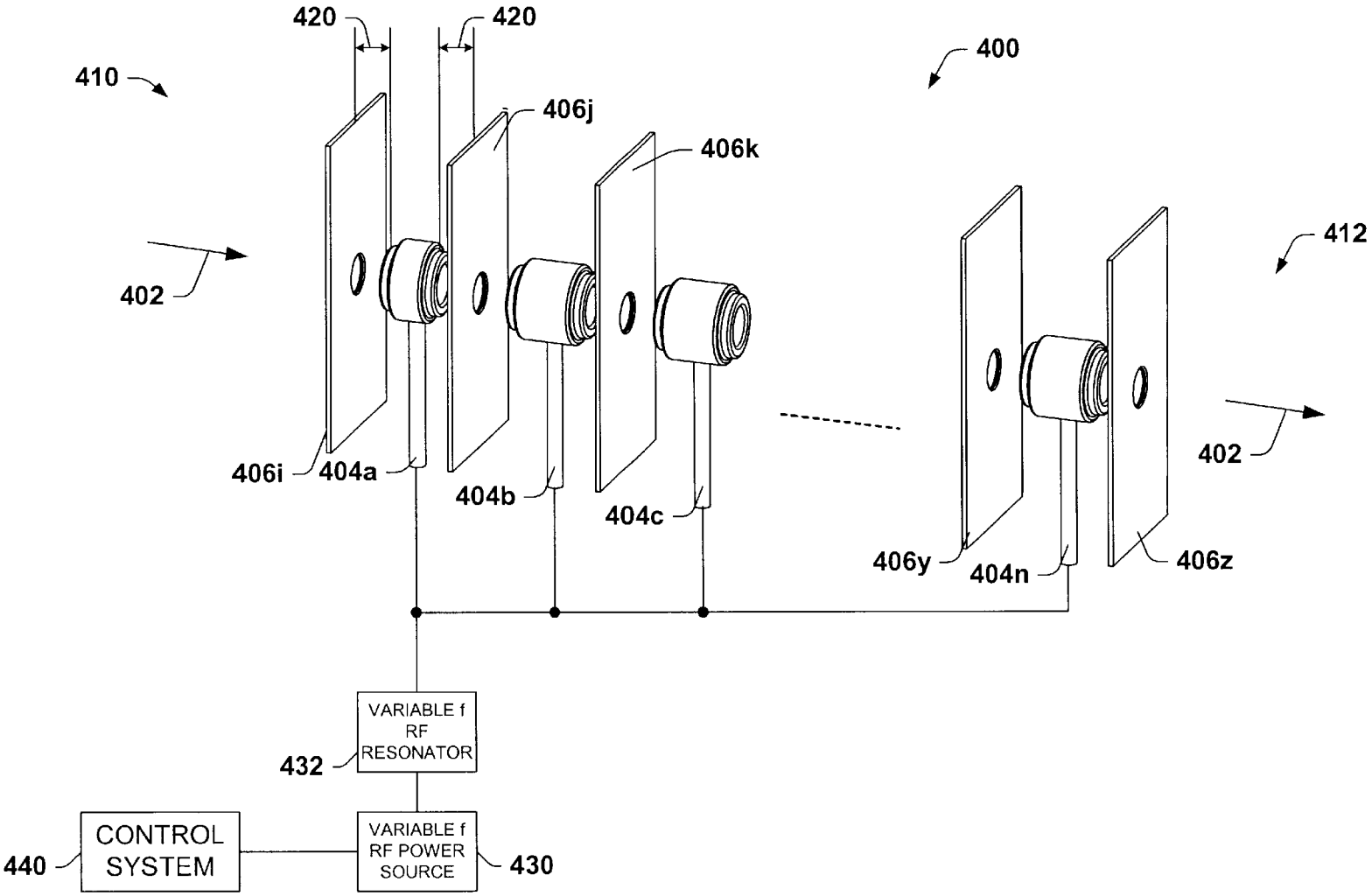
FIG. 6 is a perspective view of a portion of an exemplary ion accelerator having a plurality of energizable electrodes and a variable frequency power source in accordance with an aspect of the present invention.

According to another aspect of the invention, further improvement in cost, size, and flexibility is provided via the employment of a plurality of energizable electrodes (e.g., with greater than 2 associated accelerating gaps) in association with a single variable frequency RF system. Referring now to FIG. 6, an exemplary multiple-electrode ion accelerating stage 400 is illustrated for accelerating ions traveling along a beam 402 path. The accelerating stage 400 comprises a plurality of energizable electrodes 404*a*, 404*b*, 404*c*, through 404*n* (e.g., where n is an integer) spaced from one another in series along the path 402.

Interleaved between adjacent energizable electrodes are a plurality of constant potential (e.g., grounded) electrodes 406*i*, 406*j*, 406*k*, through 406*y* and 406*z* arranged along the path 402 with at least one constant potential electrode (e.g., electrodes 406*j*, 406*k*, through 406*y*) located between each adjacent pair of energizable electrodes 404*a*, 404*b*, 404*c*, through 404*n*. A first constant potential electrode 406*i* is located upstream of the electrodes 404 along the path 402 (e.g., between the electrodes 404*a* through 404*n* and an entrance end 410 of the accelerating stage 400), and a second constant potential electrode 406*z* is located downstream of the electrodes 404 (e.g., between the electrodes 404*a* through 404*n* and an accelerator exit end 412). The constant potential electrodes 406*i* through 406*z* are spaced from adjacent energizable electrodes 404*a* through 404*n* so as to define generally equal accelerating gaps 420 therebetween.

A variable frequency RF system is provided with a variable frequency RF power source 430 electrically connected with the energizable electrodes 404*a* through 404*n* via a variable frequency resonator 432, whereby an alternating potential of a controlled frequency and amplitude may be applied to the energizable electrodes 404*a* through 404*n* in order to create alternating electric fields in the accelerating gaps 420 in a controlled fashion. The frequency and/or amplitude of the alternating fields in the gaps 420 (e.g., as well as the relative phasing thereof with respect to other ion implantation system components, such as additional accelerating stages) may be adjusted via a control system 440, whereby ions are accelerated through the accelerating stage 400 along the path 402.

The employment of a single RF power source 430 and associated RF resonator 432 significantly reduces the size and cost of the accelerating stage 400 (e.g., compared with that of conventional accelerator 228 and the exemplary accelerator 300 of FIG. 5). Although the power source and resonator 430 and 432, respectively, may be of higher power rating than the individual supplies 310 and resonators 312, respectively, of FIG. 5, a single high power power source 430 is typically smaller in physical size (e.g., and less costly) than a plurality of dedicated (e.g., lower power rating) amplifiers 310. The same is true of the single (e.g., high power rating) resonator 432. Thus, the size and cost of the accelerating stage 400 are reduced.

In addition, the complexity of the accelerating stage 400 (e.g., as well as that of the control system 440) is significantly lower than that of the accelerators 228 and 300 illustrated and described above. Thus, it is relatively easy to tune or optimize the accelerating stage 400 for accelerating ions of a particular species and a particular energy. It will be noted that whereas such tuning of the exemplary systems 228 and 300 required adjustment of a large number of amplifiers and resonators, that tuning the control system 440 associated with the exemplary accelerating stage 400 involves only the adjustment of the frequency and/or amplitude of a single power source 430 and resonator 432. Additionally, the control system may further adjust the phasing of the RF power from the power source 430 with respect to other system components (e.g., other accelerating stages) as needed.

Moreover, the frequency range of the power source 430 provides for a wide range of support for different ion species and associated energy levels. This adjustability or flexibility of the accelerating stage 400 has been found by the inventors to match or exceed that of conventional ion accelerators (e.g., accelerator 228). For example, the adjustment of electric field frequency in the accelerating gaps 420 via the variable frequency power source 430 and resonator 432 provides for generally consistent accelerator efficiency for various particle species typically implanted in ion implantation systems. Prior systems (e.g., accelerator 228), although flexible, may not be able to achieve such efficiencies across many species types and energies, due to difficulty in adjustment of the numerous variables in such systems and limitations in the sophistication of available control systems. In addition, any individual accelerator module of the fixed-frequency accelerator 228 is necessarily optimized for only one design species and energy, and while other species and energies may be provided therewith, the acceleration efficiency is less than optimal for those other species and/or energies. The exemplary accelerating stage 400, on the other hand, provides for resonance at a plurality of operating frequencies, thereby ensuring tunability (e.g., and ease thereof, even using relatively simple controls) and predictable efficiency. For instance, the variable frequency power source 430 and resonator 432 may be designed to operate in a frequency range between one and about ten times a reference frequency. In one implementation, a range of between about 4 MHz and 40 MHz is contemplated, in order to support a wide range of typically used implant species.

Thus, in addition to the cost and size improvements resulting from the use of multiple energizable electrodes 404, the exemplary accelerating stage 400 achieves further cost and size improvements associated with the elimination of numerous power sources and resonators. Moreover, no adjustment flexibility is sacrificed, as may be the case in the accelerator 300 of FIG. 5. Indeed, the inventors have found that the accelerating stage 400 may achieve greater adjustment flexibility than conventional systems (e.g., accelerator 228), in addition to the cost, size, and complexity improvements described above.

Figure 7:
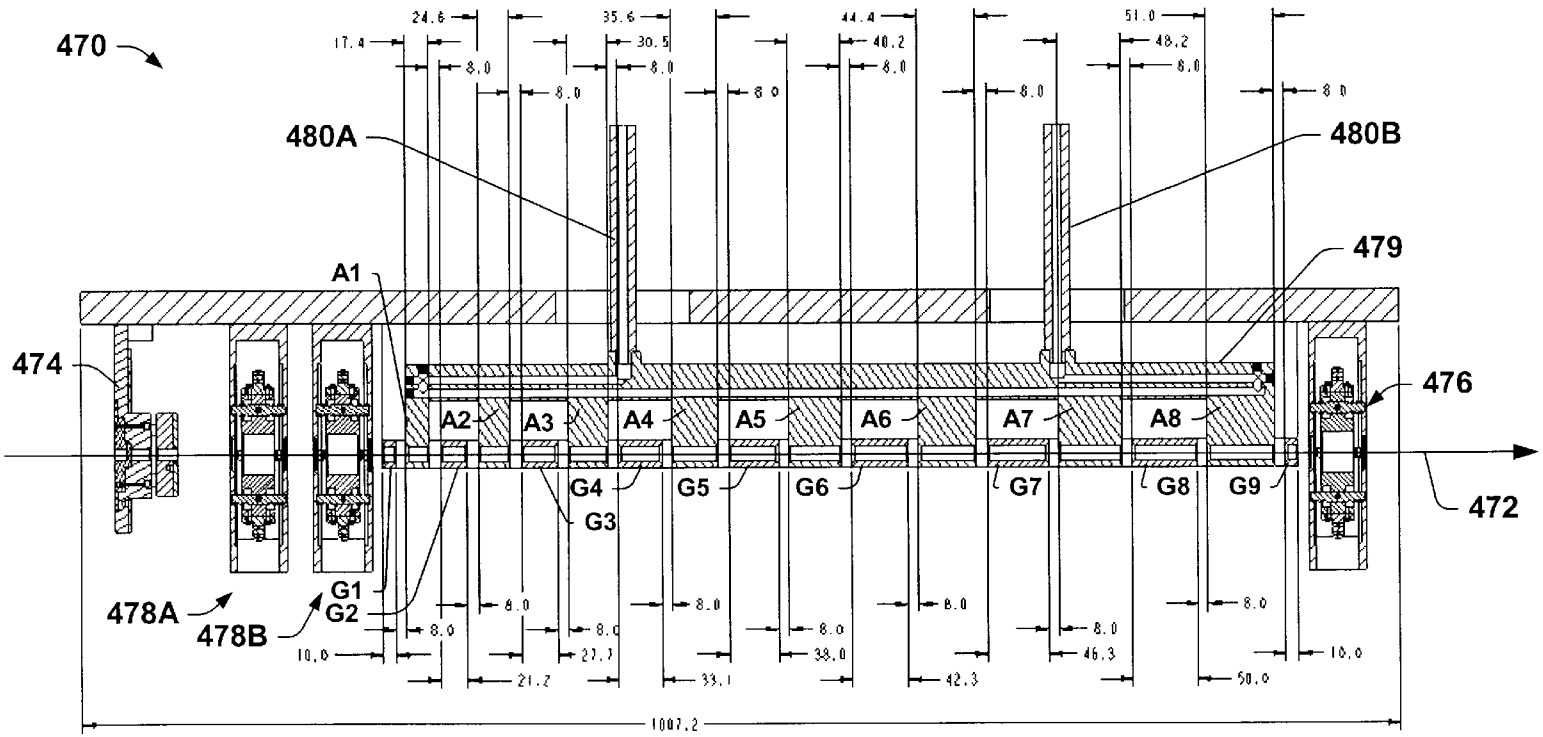
FIG. 7 is a sectional side elevation view of another exemplary ion accelerator having a plurality of energizable electrodes for use with a variable frequency power source in accordance with an aspect of the present invention.

Although the energizable electrodes 404 and grounded electrodes 406 of the exemplary ion accelerator 400 are illustrated in FIG. 6 as having roughly equal lengths, the lengths of the various electrodes may be designed for improved ion acceleration performance. Thus, according to another aspect of the invention, the electrode lengths may increase from the entrance end to the exit end of the accelerating stage. One implementation of this feature is illustrated in FIG. 7, wherein an exemplary accelerator 470 includes eight energizable electrodes A1, A2, A3, A4, A5, A6, A7, and A8 spaced along a beam path 472 between a buncher stage 474, and a radial focusing device 476 at the exit end of the accelerator 470. The buncher stage 474 may be operatively connected to an associated variable frequency RF power source and resonator (not shown) to energize an energizable electrode thereof in order to provide bunched ions to the energizable electrodes A1, A2, A3, A4, A5, A6, A7, and A8 in the accelerating stage downstream along the path 472.

Two matching quadrupole focusing devices 478A and 478B are located along the path 472 between the buncher stage 474 and the first energizable electrode A1. Constant potential or grounded electrodes G1, G2, G3, G4, G5, G6, G7, G8, and G9 are interleaved between the energizable electrodes A1–A8 along the path 476, with the first grounded electrode G1 located upstream of the first energizable electrode A1, and with the last grounded electrode G9 located downstream of the final energizable electrode A8. The grounded electrodes G1–G9 may, but need not, include radial or transverse focusing devices, such as electrostatic or magnetic quadrupoles (not shown) in order to provide radial focusing of an ion beam traveling along the path 472.

The energizable electrodes A1–A8 each extend radially toward the beam path 472 from a support member 479 which extends generally parallel to the beam path 472 between the matching quadrupole 478B and the focusing device 476. The support member 479 includes a pair of vertically extending support members 480A and 480B providing mechanical support for the energizable electrodes A1–A8 and the support member 479, as well as providing for electrical connection thereof with a variable frequency RF system (not shown) to energize the electrodes A1–A8. Although the exemplary accelerator 470 includes two such vertical members 480, any number of such members may be included in order to provide support as well as to reduce voltage differentials between energizable electrodes A1–A8.

The energizable electrodes A1–A8 as well as the grounded electrodes G1–G8 include passages or drift tubes through which ions travel along the beam path 472. For improved acceleration efficiency, the lengths of the various electrodes A1–A8 and G1–G8 and the length of the gaps therebetween may be designed such that ions along the path 472 travel from the center of one electrode gap to the center of the next gap in one half cycle of the RF energy being applied to the energizable electrodes A1–A8. As such ions are accelerated in successive accelerating gaps along the beam path 472, the lengths of the drift tubes and the center-to-center spacing thereof may be advantageously increased in order to facilitate the provision of energy at the appropriate phase as the particles are further accelerated from gap to gap.

Thus, whereas accelerators having fixed frequency RF amplifiers and resonators employ phasing adjustment between successive energizable electrodes to improve efficiency (e.g., to thereby adjust the relative phase of electric fields within successive accelerating gaps), the use of a variable frequency RF power source according to the present invention provides appropriate phase advance as ions travel from one accelerating gap to the next, without the need for independent phase control, thereby making the overall system simpler to adjust. In this regard, acceleration efficiency will be maximum for an ion with a certain velocity such that the RF phase changes by 180 degrees as the ion travels from the center of the first accelerating gap (e.g., the gap between an energizable electrode A and a grounded electrode G) to the center of the second gap, and so on through successive gaps along the path 472. The provision of a variable frequency power source according to the present invention facilitates achievement of optimal or improved acceleration efficiency for a wide range of ion species according to the operational frequency range of the power system. For instance, an RF system having an operating range of approximately 4–40 MHz has been found to provide for significantly improved acceleration efficiency for ion species of interest compared with prior fixed frequency accelerator designs having only phase adjustment at a fixed frequency.

In the exemplary accelerator 470 of FIG. 7, the drift tube lengths are illustrated for the exemplary energizable electrodes A1–A8 as well as for the grounded electrodes G1–G8, with each subsequent electrode having a longer drift tube length than the previous electrode. In this exemplary design, the center to center spacing of the accelerating gaps L is roughly equal to the design particle velocity divided by twice the RF frequency, such that particles travel from one gap to the next in roughly 180 degrees of the RF cycle, wherein the design velocity is the particle velocity as it drifts through the drift tube. Thus, for an accelerator (e.g., accelerator 470) having an integer number n drift tubes (e.g., wherein n=1, 2, . . . , N), each with a peak RF potential Vrf and an injector voltage Vi (e.g., the voltage at which ions are injected into the accelerator), the drift tube gap to gap lengths Ln of the energizable electrodes (e.g., electrodes A1–A8) may be determined by the following equation:

$$Ln=f^{-1}[\tfrac{1}{2}(q/m)(Vi+(2n-1)Vrf\cos\phi)]^{1/2} \quad (1)$$

where q is the charge of the particle, m is the mass, and $\phi$ is typically +/− 30 degrees such that cos $\phi$ is $\frac{1}{2}[3]^{1/2}$. In addition, for the grounded electrodes (e.g., electrodes G2–G8 interleaved between the energizable electrodes A1–A8), the gap to gap distances Lg may be determined by the following equation:

$$Lg=f^{-1}[\tfrac{1}{2}(q/m)(Vi+2nVrf\cos\phi)]^{1/2} \quad (2)$$

The gap lengths and the drift tube lengths are illustrated for the exemplary accelerator 470 in FIG. 7, wherein the dimensions are in millimeters. The final beam energy E may be expressed by the following equation:

$$E=q(Vi+2NVrf\cos\phi). \quad (3)$$

In the exemplary implementation of FIG. 7, the design values of frequency ($f_D$), charge to mass ratio $(q/m)_D$, peak RF voltage ($Vrf_D$), and injection energy ($Vi_D$) may be employed such that the drift tube lengths and final energy are determined according to the following equations:

$$Ln=f_D^{-1}[\tfrac{1}{2}(q/m)_D(Vi_D+(2n-1)Vrf_D\cos\phi)]^{1/2} \quad (4)$$

$$E_D=q(Vi_D+2NVrf_D\cos\phi). \quad (5)$$

The resultant operation for the drift tubes under other conditions may require the following scaling, wherein $\alpha$ is less than or equal to 1:

$$Vi=\alpha Vi_D; \quad (6)$$

$$Vrf=\alpha Vrf_D; \quad (7)$$

$$[(q/m)\alpha]^{1/2}/f=[(q/m)_D]^{1/2}/f_D; \quad (8)$$

and $$E=\alpha E_D q/q_D. \quad (9)$$

Accordingly, for a given charge to mass ratio q/m, the designed energy $E_D$ may be achieved at an operating frequency fmax given by the following equation:

$$fmax=f_D[(q/m)/(q/m)_D]^{1/2}. \quad (10)$$

In addition, lower energies may be obtained by reducing the voltages linearly and scaling the frequency according to the following equation:

$$f=\alpha^{1/2}fmax. \quad (11)$$

Figure 8A:
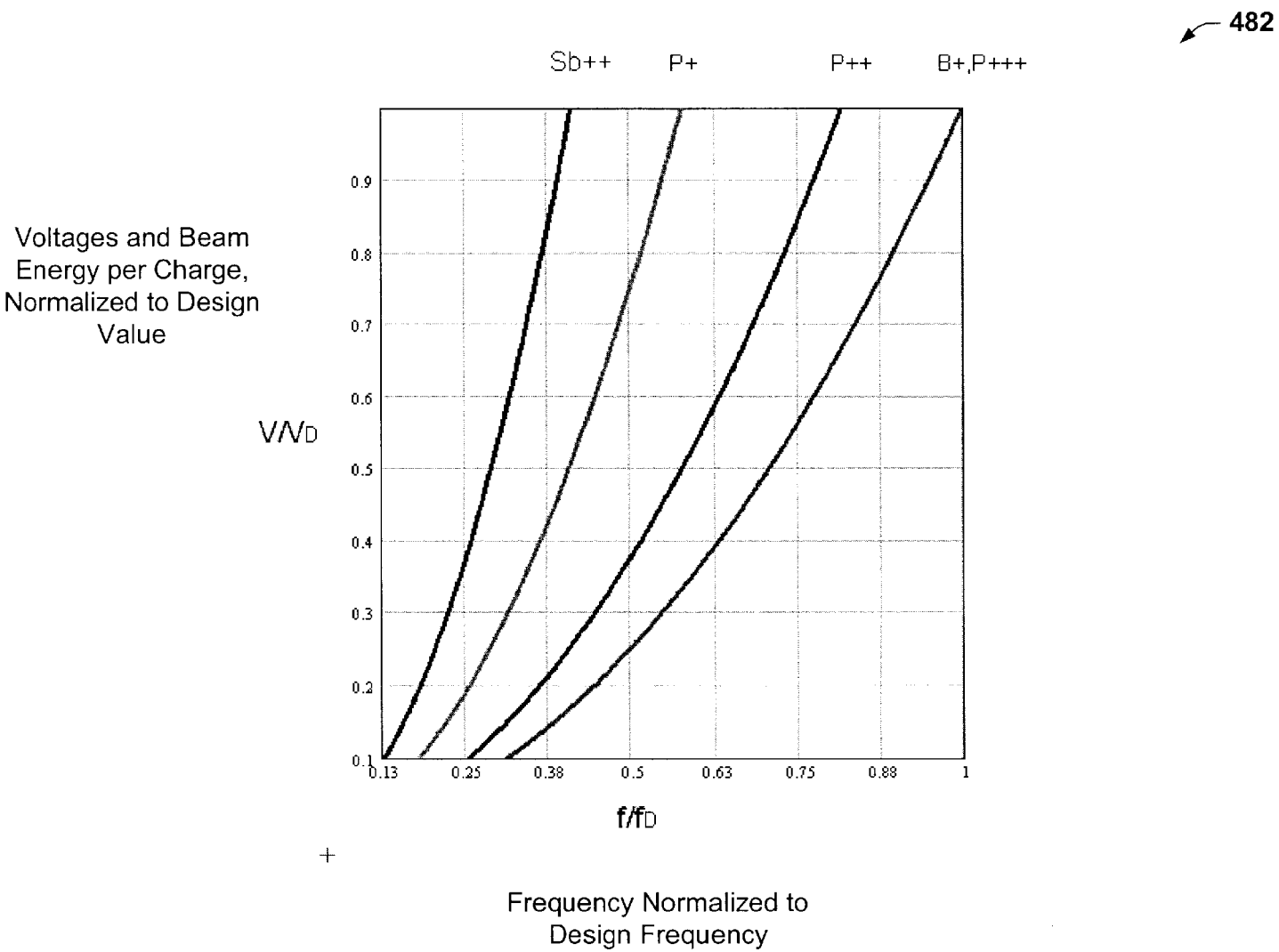
FIG. 8A is a plot of exemplary voltage and frequency operating curves for various ion species in accordance with the invention.
Figure 8B:
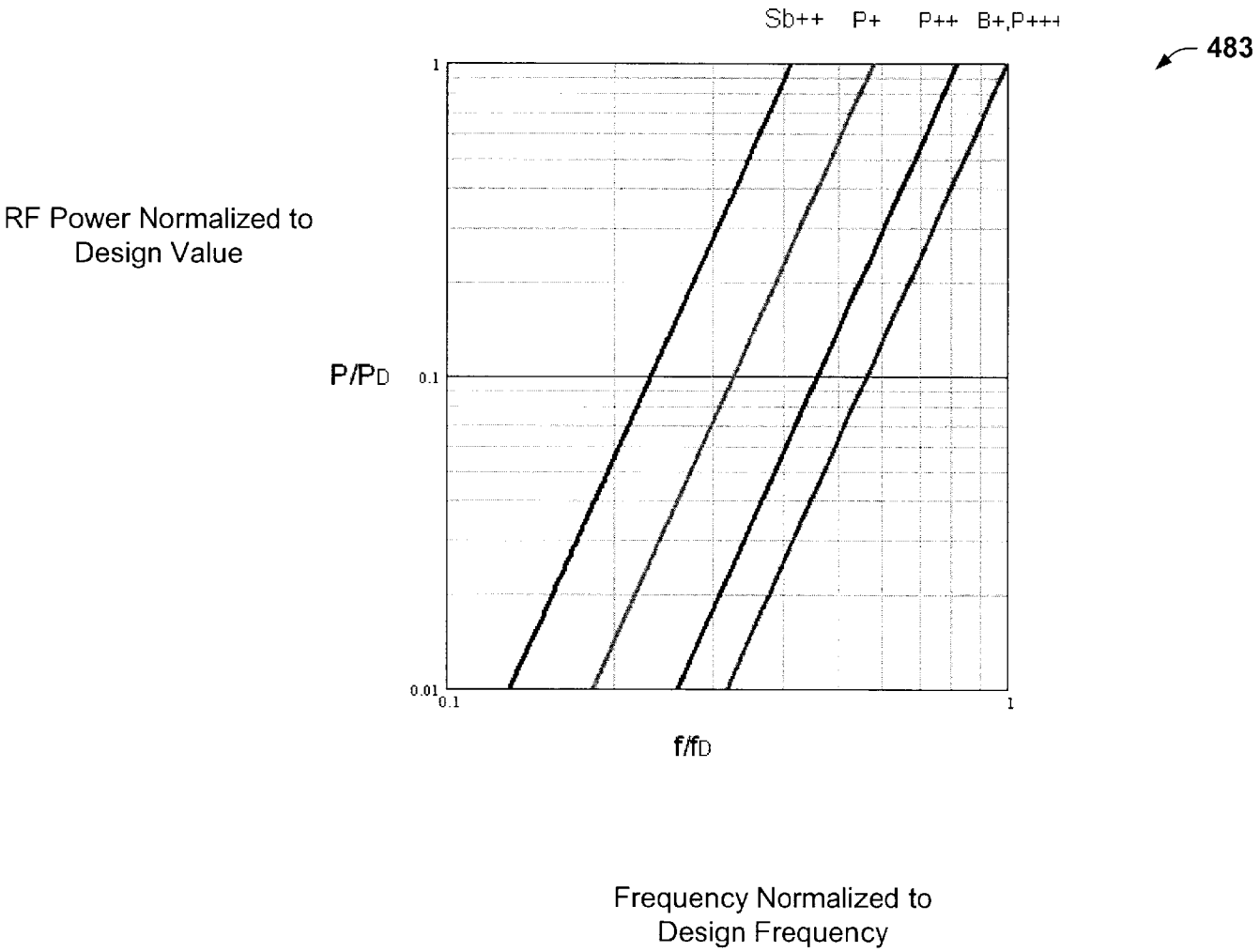
FIG. 8B is a plot of exemplary power and frequency operating curves for various ion species in accordance with the invention.

Referring now to FIG. 8A an exemplary normalized voltage vs. frequency plot 482 is illustrated for various ion species (e.g., Sb++, P+, P++, B+, and P+++). The resulting curves were obtained for a design species of B+. In FIG. 8B, an exemplary plot 483 of normalized power vs. frequency is illustrated for Sb++, P+, P++, B+, and P+++ ion species.

Figure 9B:
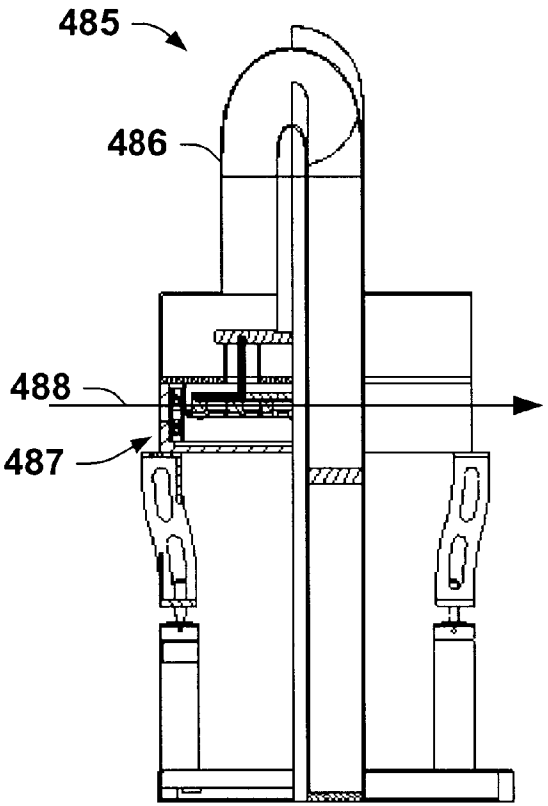
FIG. 9B is a sectional front elevation view of the ion accelerator and resonator of FIG. 9A.
Figure 9A:
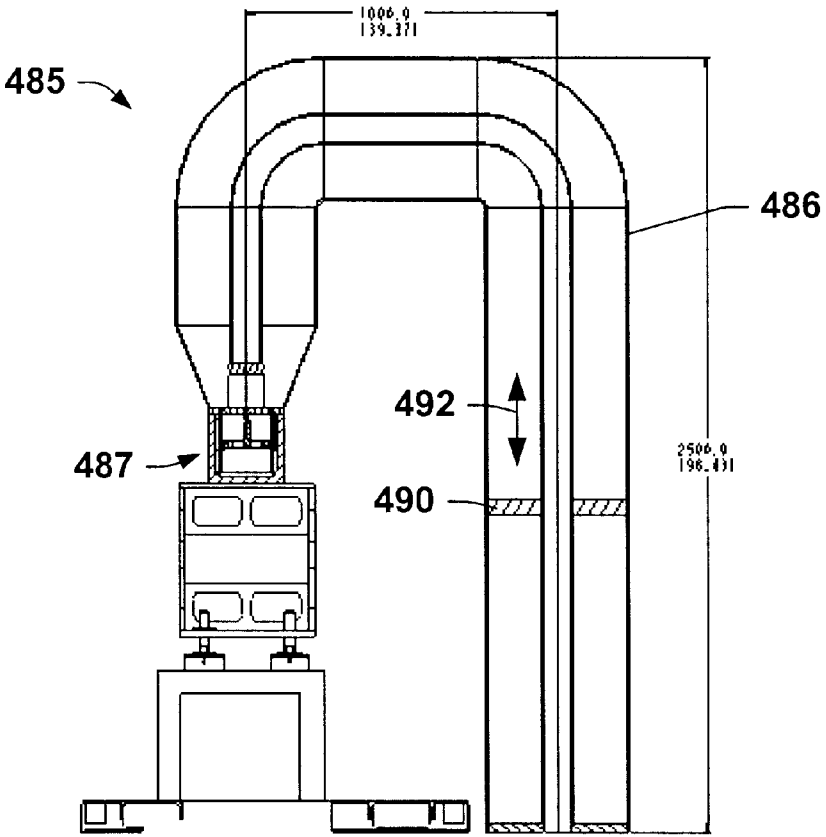
FIG. 9A is a sectional side elevation view of an ion accelerator with an exemplary variable frequency coaxial resonator.

Further in accordance with the invention, FIGS. 9A and 9B illustrate an ion accelerator system 485 with an exemplary variable frequency coaxial resonator 486 and an accelerating stage 487 (e.g., similar to the exemplary accelerating stage 470 of FIG. 7) for accelerating ions along a beam path 488. The resonator 486 may be advantageously employed in association with a variable frequency RF power source (not shown), whereby the resonator provides a wide range of resonant frequency adjustment substantially corresponding with that of the power source (e.g., from one to ten times a given frequency). In the exemplary resonator 486, a shunt 490 is movable in the direction of arrow 492 in order to tune the resonator to a desired operating frequency. For example, the resonator 486 may provide for controllable frequency adjustment in the range of about 4–40 MHz.

Figure 10:
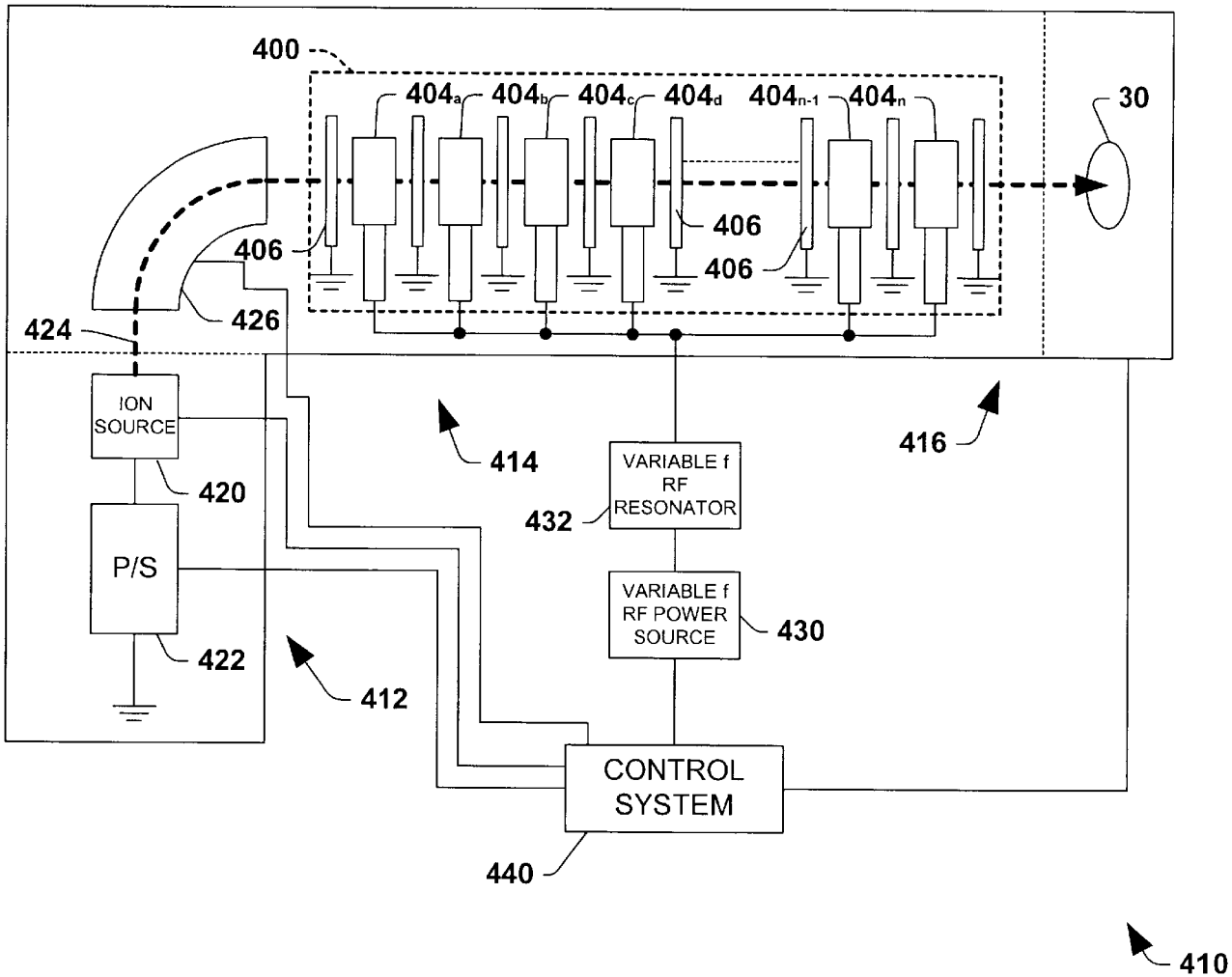
FIG. 10 is a schematic illustration of an ion implantation system including an exemplary ion accelerator having a plurality of energizable electrodes and a variable frequency power source in accordance with another aspect of the invention.

According to another aspect of the invention, the exemplary accelerating stage 400 may be incorporated into an ion implantation system 410, as illustrated in FIG. 10. In this regard, the exemplary control system 440 may be operable to control the accelerating stage 400 as well as other system components. The system 410 includes a terminal 412, a beamline assembly 414 (e.g., including the exemplary accelerating stage 400), and an end station 416. The terminal 412 operates in similar fashion to the terminal 12 of FIG. 1, and includes an ion source 420 powered by a high voltage power supply 422. The ion source 420 produces an ion beam 424, which is provided to the beamline assembly 414. The ion beam 424 is then directed toward a target wafer 30 in the end station 416. The ion beam 424 is conditioned by the beamline assembly 414, which comprises a mass analysis magnet 426 and the accelerating stage 400. The mass analysis magnet 426 passes only ions of an appropriate charge-to-mass ratio to the accelerating stage 400.

Figure 11:
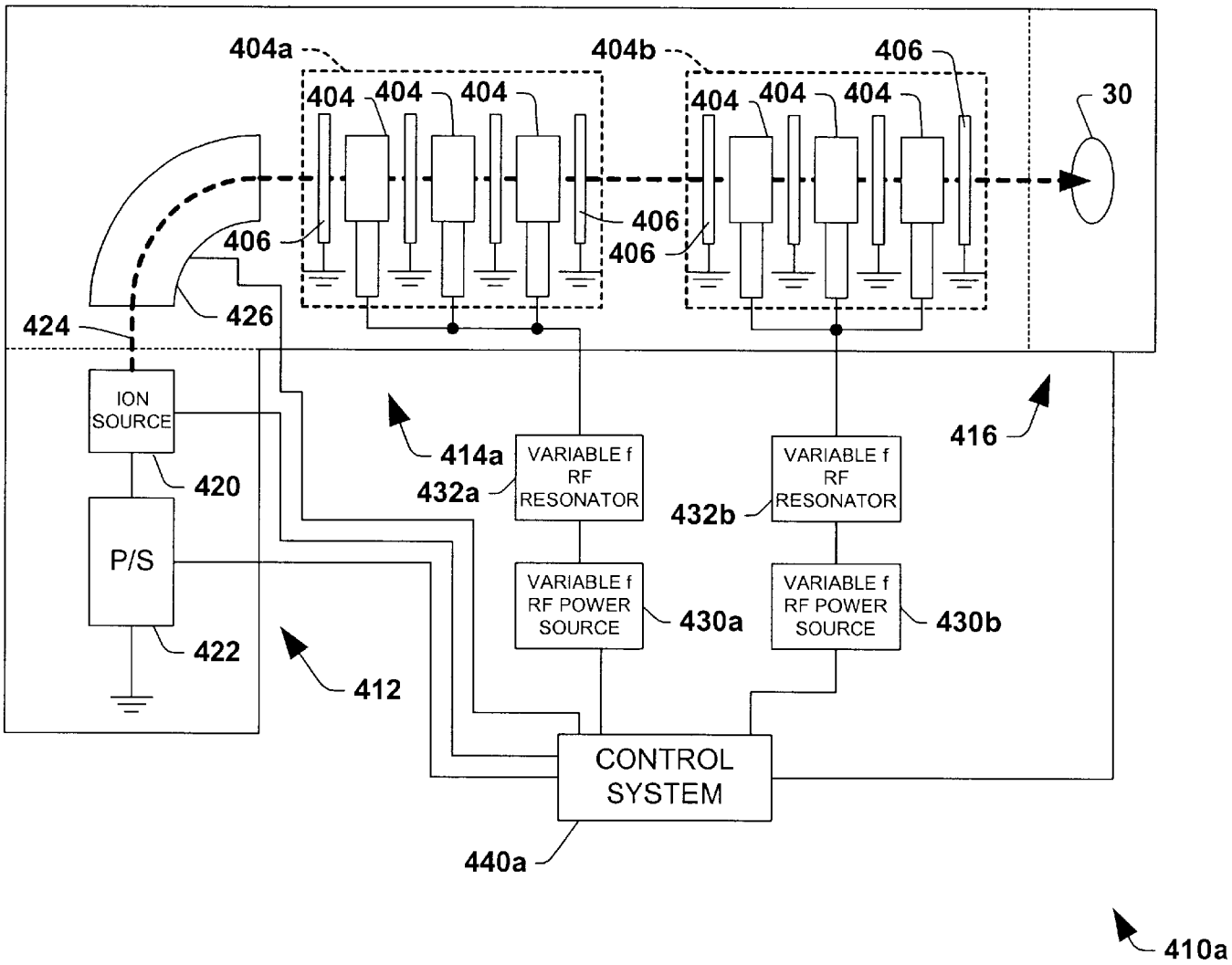
FIG. 11 is a schematic illustration of another ion implantation system including an exemplary dual stage ion accelerator, where each accelerating stage comprises a plurality of energizable electrodes and a variable frequency power source in accordance with another aspect of the invention.

Referring now to FIG. 11, the invention further contemplates the provision of two or more such accelerating stages in an ion implantation system. The inventors have appreciated that the employment of multiple variable frequency accelerator stages or modules rather than one module may alleviate the RF design and control requirements in some applications. For instance, in an ion implantation system designed to operate over a wide range of final or output ion energies, only the first module would be used for lower range energies, with one or more additional accelerating stages turned on to achieve higher energies. Thus, an implanter designed to deliver, for example, 100 keV to 1600 keV singly charged ions in the mass range of 5–45 AMU, with a maximum injection energy (e.g., ion energy entering the accelerator) of 100 keV may be built using multiple variable frequency accelerating stages according to the invention. If such an accelerator were built as a single module, the range of frequency tunability would be a factor of 12, while the range of electrode voltage control would be a factor of about 16. A typical two stage design would reduce the required frequency range to a factor of 6 and the required electrode control range to a factor of 4. In this example, only the first module would be turned on to achieve energies in the range of 100 keV to 400 keV. For higher energies, both modules would be on. Each module would require its own tunable resonator and RF power system. The second and subsequent modules would always be phase locked to the first module and would operate at the same frequency as the first module or a harmonic thereof, though relative phase of modules may be adjustable.

In FIG. 11, an example of such a system 410*a* is illustrated, which comprises two accelerating stages 410*a* and 410*b* in a beamline assembly 414*a,* each of which includes a plurality of energizable electrodes 404 and grounded electrodes 406 along the path of the ion beam 424. The accelerating stages 404*a* and 404*b* are individually associated with variable frequency RF power sources 430*a* and 430*b,* respectively, as well as variable frequency resonators 432*a,* and 432*b,* respectively. The operating frequencies in the individual stages 404*a* and 404*b* may be the same or one may be set to a harmonic of the other. Furthermore, a variable frequency buncher stage (not shown) may be provided upstream of the initial accelerating stage 404*a* in the accelerator, which may also be operated at the accelerating stage frequency or a harmonic thereof. Moreover, the relative phasing between the accelerating stages 404*a* and 404*b* (e.g., and that of an upstream variable frequency buncher stage) may be controlled, and further may be adjustable. The setting of such relative phasing may be accomplished by any appropriate means, including the control system 404*a*.

A control system 440*a* may be operable to control the frequencies and amplitudes of the respective power sources 430*a* and 430*b* and resonators 432*a,* and 432*b* to affect a desired net acceleration of the beam 424 through the beamline assembly 414*a,* as well as the relative phasing of the energy applied to the stages 404*a* and 404*b*. In addition, the control system 440*a* may further be operative to control other system components, such as the ion source 420, the power supply 422, the mass analysis magnet 426, and/or the end station 416. It will be appreciated in this regard, that any number of such accelerating stages 404*n* (e.g., where n is an integer) may be provided in an ion implantation system in accordance with the invention.

The employment of multiple variable frequency accelerating stages may provide several operational advantages over conventional ion implantation systems and accelerators. For instance, the individual RF systems (e.g., power source 430*a* and resonator 432*a,* and/or power source 430*b* and resonator 432*b*) in FIG. 11 may be operable in a somewhat smaller frequency range than that of the RF system (amplifier 430 and resonator 432) of FIG. 10, while providing the capability of accelerating the same range of ion species and energy levels. In this regard, the first stage 404*a* could be employed in accelerating a first (e.g., lower) ion energy range while the second stage 404*b* is de-energized. Within this first stage, the frequency and voltage provided by the amplifier 430*a* and resonator 432*a* can be adjusted according to desired final particle energies within the range. A second (e.g., higher) particle energy range could also be accommodated by energizing both the accelerating stages 404*a* and 404*b,* with appropriate adjustments to the frequencies and voltages of the corresponding RF systems.

Figure 12:
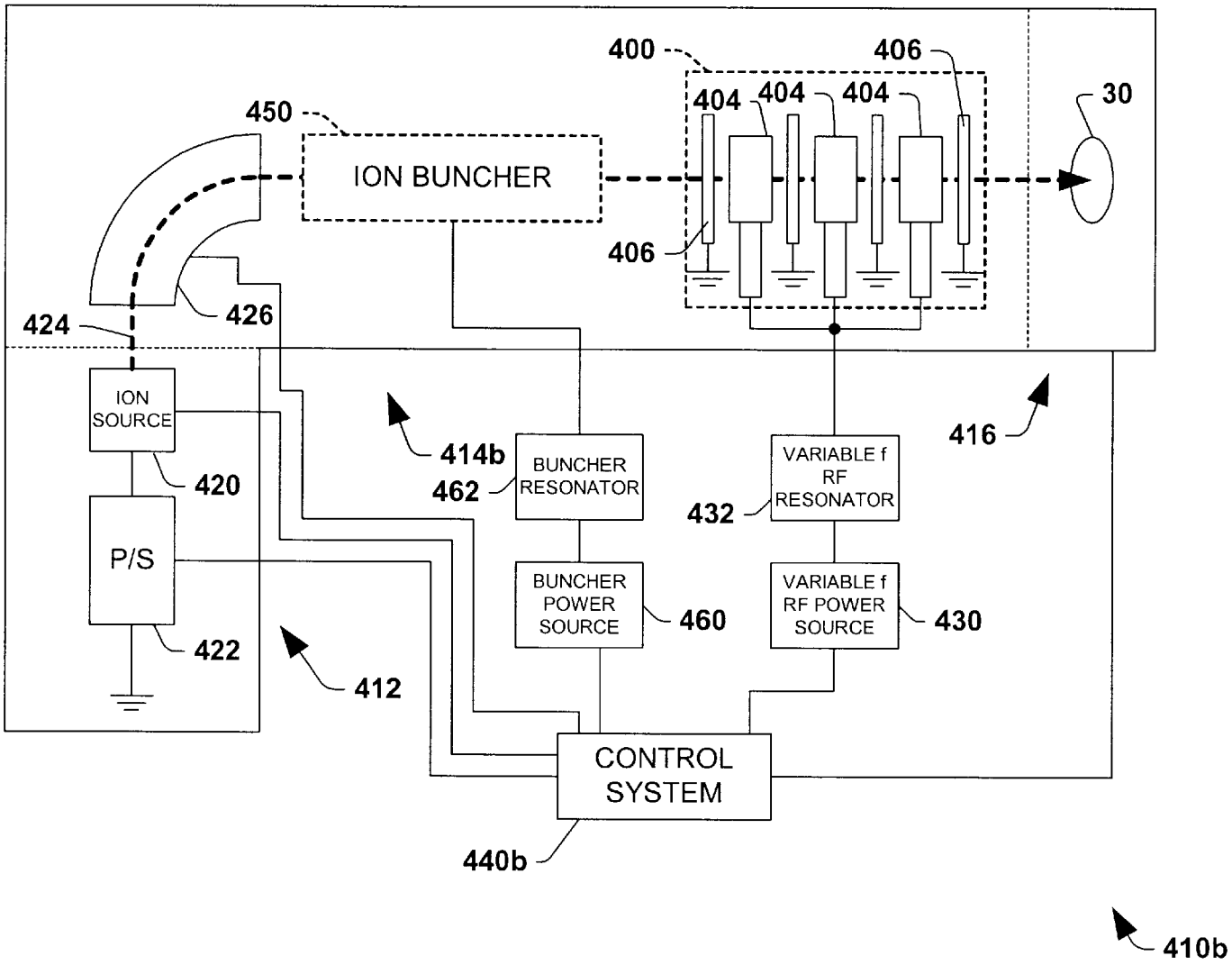
FIG. 12 is a schematic illustration of another ion implantation system including an exemplary ion accelerator having a plurality of energizable electrodes and a variable frequency power source, as well as an ion buncher in accordance with another aspect of the invention.

A further aspect of the invention provides for combining one or more of the accelerating stages (e.g., stages 400) with an ion buncher stage in an ion accelerator. Referring now to FIG. 12, another exemplary ion implantation system 410*b* is illustrated having a single accelerating stage 400 in a beamline assembly 414*b,* preceded along the path of the beam 424 by an ion buncher 450. The buncher stage has a variable frequency buncher power source 460 and a variable frequency resonator 462 associated therewith to facilitate bunching of ions from the ion source 420. The bunched ions are then provided to the accelerating stage 400 for acceleration thereof to a desired energy prior to implantation on the workpiece 30. The buncher power source 460 and resonator 462 may be operated at the accelerating stage frequency or a harmonic thereof. Moreover, the relative phasing between the accelerating stage 400 and the variable frequency buncher stage 450 may be controlled, and also may be adjustable.

The setting of such relative phasing and other control functions in the system 410*b* may be accomplished by any appropriate means, including a control system 440*b*. The control system 440*b* may be adapted to control operation of both the exemplary accelerating stage 400 as well as other components in the ion implantation system 410*b*, including the ion buncher 450, buncher power source 460, and the buncher resonator 462. It will be appreciated that such an implantation system 410*b* may further comprise additional accelerating stages 400 positioned along the path of the ion beam 424 in accordance with the present invention.

Figure 14:
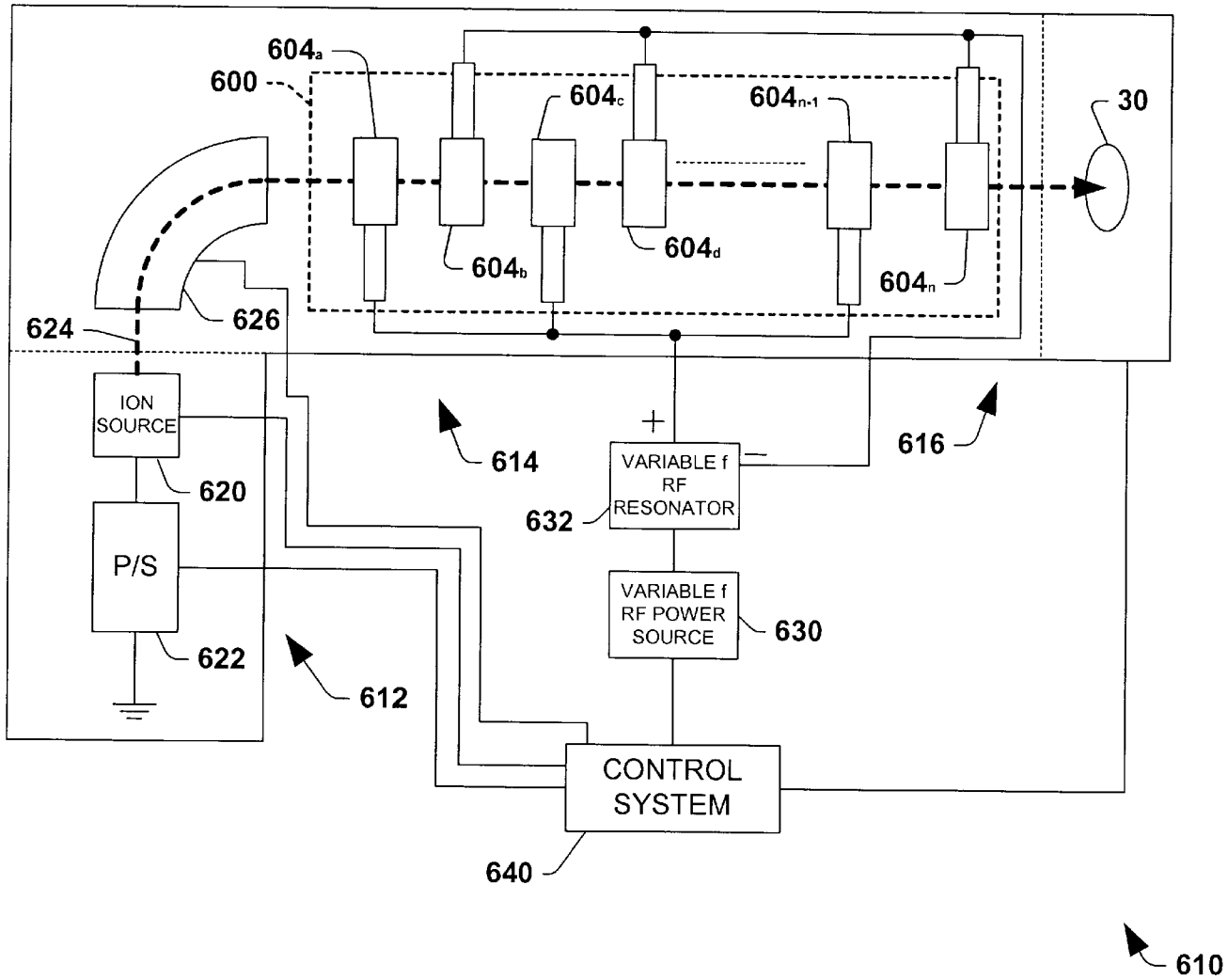
FIG. 14 is a schematic illustration of an ion implantation system including an exemplary ion accelerator having first and second energizable electrodes energized by a variable frequency RF system in a phased relationship with one another according to another aspect of the invention.

The present invention finds application in a variety of forms, including those illustrated and described herein, and others not illustrated. For instance, as illustrated in FIG. 14, an accelerating stage 600 may be provided in an implantation system 610 with a variable frequency RF power source 630 and a corresponding variable frequency resonator 632 where the accelerating stage 600 comprises energizable electrodes spaced along a beam path, which are energized by the RF system. As with the other implantation systems illustrated herein, the system 610 comprises a terminal 612, a beamline assembly 614, and an end station 616. The terminal 612 includes an ion source 620 powered by a high voltage power supply 622. The ion source 620 produces an ion beam 624, which is provided to the beamline assembly 614. The ion beam 624 is then directed toward a target wafer 30 in the end station 616. The ion beam 624 is conditioned by the beamline assembly 614, which comprises a mass analysis magnet 626 and the accelerating stage 600. The mass analysis magnet 626 passes only ions of an appropriate charge-to-mass ratio to the accelerating stage 600.

The accelerating stage 600 comprises interleaved RF energizable electrodes driven 180 electrical degrees apart in phase via the power source 630 and the resonator 632, whereby push-pull accelerating fields are generated in the accelerating gaps therebetween, without any grounded or constant potential electrodes interposed therebetween. Thus, in the accelerating stage 600, a plurality of first energizable electrodes 604*a*, 604*c*, and 604*n* are energized via connection with a first (e.g., "+") terminal of the resonator 632 and one or more second energizable electrodes 604*b*, 604*d*, and 604*n* are energized via a second (e.g., "−") terminal thereof. In this manner, for instance, a 180 degree phase relationship is provided between adjacent energizable electrodes along the path of the beam 624.

Figure 13:
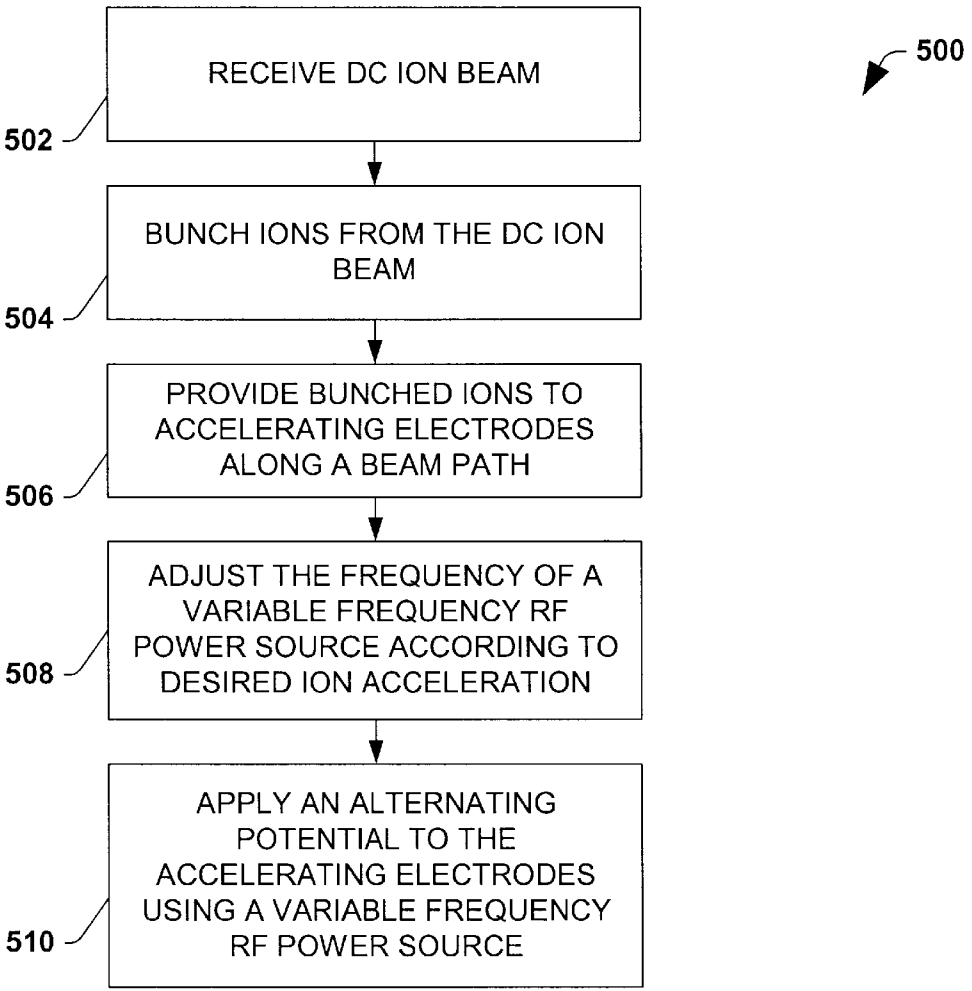
FIG. 13 is a flow diagram illustrating an exemplary method of accelerating ions in an ion implantation system in accordance with another aspect of the present invention.

Another aspect of the invention provides a method for accelerating ions in an ion implantation system. An exemplary method 500 is illustrated in FIG. 13. Although the exemplary method 500 is illustrated and described herein as a series of steps, it will be appreciated that the present invention is not limited by the illustrated ordering of steps, as some steps may occur in different orders and/or concurrently with other steps apart from that shown and described herein, in accordance with the invention. In addition, not all illustrated steps may be required to implement a methodology in accordance with the present invention. Moreover, it will be appreciated that the method 500 may be implemented in association with the apparatus and systems illustrated and described herein as well as in association with other systems not illustrated.

In accordance with the method 500, a DC ion beam is received at step 502. The ion beam may be supplied, for example, by an ion source, such as source 420 of FIG. 12, and may be conditioned in a mass analysis magnet 426. Thereafter, the beam may be bunched (e.g., using an ion buncher 450) at step 504. The bunched ions are provided to one or more energizable electrodes (e.g., energizable electrodes 404) along a path at step 506. An alternating potential is applied to the energizable electrodes at step 510 using a variable frequency RF system (e.g., power source 430 and associated resonator). The frequency of the power source may be adjusted at step 508, as needed, in order to provide the desired acceleration of the ions. The provision of a plurality of energizable electrodes and the energization thereof using a variable frequency RF power source at step 510 provides significant advantages over acceleration techniques employed in conventional ion implantation systems. Furthermore, it will be appreciated that the tuning of an ion implantation system for a specific ion species and/or specific energy is greatly simplified by the invention, whereby the adjustment of the frequency of operation at step 508 may provide for such tuning.

Although the invention has been shown and described with respect to a certain aspects and implementations, it will be appreciated that equivalent alterations and modifications will occur to others skilled in the art upon the reading and understanding of this specification and the annexed drawings. In particular regard to the various functions performed by the above described components (assemblies, devices, circuits, systems, etc.), the terms (including a reference to a "means") used to describe such components are intended to correspond, unless otherwise indicated, to any component which performs the specified function of the described component (i.e., that is functionally equivalent), even though not structurally equivalent to the disclosed structure, which performs the function in the herein illustrated exemplary implementations of the invention. In this regard, it will also be recognized that the invention includes a computer-readable medium having computer-executable instructions for performing the steps of the various methods of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "includes", "including", "has", "having", "with", and variants thereof are used in either the detailed description or the claims, these terms are intended to be inclusive in a manner similar to the term "comprising".

What is claimed is:

1. An ion accelerator for accelerating ions traveling along a path in an ion implantation system, the accelerator comprising:

a first accelerating stage comprising a first series of energizable electrodes spaced from one another along the path, each energizable electrode being spaced from an adjacent energizable electrode in a direction parallel with the path; and a first variable frequency RE power source and a first variable frequency RE resonator comprising a first terminal electrically connected with every other energizable electrode in the first series and a second terminal electrically connected with remaining electrodes in the first series, the first variable frequency RF power source operable to apply alternating potentials of a controlled frequency and amplitude to the first and second terminals, the alternating potentials at the first and second terminals being out of phase with one another.

2. The ion accelerator of claim 1, wherein the variable frequency RF power source and the variable frequency RF resonator are each adjustable in a range from about 4 MHz to about 40 MHz.

3. The ion accelerator of claim 1, further comprising a variable frequency ion buncher stage located upstream of the first accelerating stage along the path, and operable to provide bunched ions to the first accelerating stage along the path.

4. The ion accelerator of claim 3, wherein variable frequency ion buncher stage comprises an energizable electrode located upstream of the first accelerating stage along the path and a variable frequency buncher RF system operable to energize the energizable electrode of the ion buncher stage at a controlled frequency corresponding to the frequency of the first accelerating stage and a controlled phase with respect to the first accelerating stage to create an alternating electric field to provide bunched ions to the first accelerating stage along the path.

5. The ion accelerator of claim 1, wherein the alternating potentials at the first and second terminals are out of phase with one another by about 180 degrees.

6. The ion accelerator of claim 1, further comprising:

a second accelerating stage spaced from and downstream of the first accelerating stage along the path, wherein the second accelerating stage comprises a second series of energizable electrodes spaced from one another along the path; and a second variable frequency RF power source and a second variable frequency RF resonator comprising a first terminal electrically connected with every other energizable electrode in the second series and a second terminal electrically connected with remaining electrodes in the second series, the second variable frequency RF power source being operable to apply alternating potentials to the first and second terminals of a controlled frequency corresponding to a harmonic of the frequency of the first accelerating stage, the alternating potentials at the first and second terminals being out of phase with one another.

7. The ion accelerator of claim 6, wherein the first and second variable frequency RF power sources are operable to fix relative phasing between the alternative potentials in the first and second accelerating stages.

8. The ion accelerator of claim 6, wherein the first and second variable frequency RF power sources are operable to adjust the relative phasing between the alternative potentials in the first and second accelerating stages.

9. The ion accelerator of claim 6, wherein the first variable frequency RF power source is adjustable to provide the alternating potential in a frequency range between a first frequency and about ten times the first frequency.

10. The ion accelerator of claim 6, further comprising a variable frequency ion buncher stage located upstream of the first accelerating stage along the path, and operable to provide bunched ions to the first accelerating stage along the path.

11. The ion accelerator of claim 10, wherein the variable frequency ion buncher stage comprises an energizable electrode located upstream of the first accelerating stage along the path and a variable frequency buncher RF system operable to energize the energizable electrode of the ion buncher stage at a controlled frequency corresponding to the frequency of the first accelerating stage and a controlled phase with respect to the first accelerating stage to create an alternating electric field to provide bunched ions to the first accelerating stage along the path.

12. An ion accelerator for accelerating ions traveling along a path in an ion implantation system, the accelerator comprising:

an accelerating stage comprising:

one or more energizable electrodes spaced from one another along the path, each energizable electrode being spaced from an adjacent energizable electrode in a direction parallel with the path; and two or more constant potential electrodes arranged along the path with a first constant potential electrode located upstream of the energizable electrodes, and a second constant potential electrode located downstream of the energizable electrodes, wherein the constant potential electrodes are spaced from adjacent energizable electrodes to define accelerating gaps therebetween;

a variable frequency RE system electrically connected with the energizable electrodes and operable to apply an alternating potential of a controlled frequency in a range between about 4 MHz and about 40 MHz to the energizable electrodes to create alternating electric fields in the accelerating gaps in a controlled fashion in order to accelerate ions through the accelerating stage along the path; and a variable frequency ion buncher stage located upstream of the accelerating stage along the path, and operable to provide bunched ions to the accelerating stage along the path.

13. The ion accelerator of claim 12, wherein the variable frequency ion buncher stage comprises an energizable electrode located upstream of the accelerating stage along the path and a variable frequency buncher RF system operable to energize the energizable electrode of the ion buncher stage at a controlled frequency corresponding to the frequency of the accelerating stage and a controlled phase with respect to the accelerating stage to create an alternating electric field along the path.

14. The ion accelerator of claim 13, wherein the variable frequency RF system of the accelerating stage comprises a variable frequency RF power source adjustable in a range between about 4 MHz and about 40 MHz and a variable frequency resonator adjustable in a range between about 4 MHz and about 40 MHz.

15. An ion accelerator for accelerating ions traveling along a path in an ion implantation system, the accelerator comprising:

a first accelerating stage comprising:

a first energizable electrode along the path; and two or more constant potential electrodes arranged along the path with a first constant potential electrode located upstream of the energizable electrode, and a second constant potential electrode located downstream of the energizable electrode, wherein the constant potential electrodes are spaced from the energizable electrode to define accelerating gaps therebetween; and a first variable frequency RF system electrically connected with the energizable electrode and operable to apply an alternating potential of a controlled frequency and amplitude to create alternating electric fields in the accelerating gaps in a controlled fashion in order to accelerate ions through the first accelerating stage along the path; and a second accelerating stage comprising:

a second energizable electrode along the path; and two or more constant potential electrodes spaced from the energizable electrode along the path to define accelerating gaps therebetween; and a second variable frequency RF system electrically connected with the second energizable electrode and operable to apply an alternating potential of a controlled amplitude and a controlled frequency corresponding to a harmonic of the frequency of the first accelerating stage to create alternating electric fields in the accelerating gaps in a controlled fashion.

16. The ion accelerator of claim 15, further comprising a variable frequency ion buncher stage located upstream of and providing bunched ions to the first accelerating stage along the path.

17. The ion accelerator of claim 16, wherein variable frequency ion buncher stage comprises an energizable electrode located upstream of the first accelerating stage along the path and a variable frequency buncher RF system operable to energize the energizable electrode of the ion buncher stage at a controlled frequency corresponding to the frequency of the first accelerating stage and a controlled phase with respect to the first accelerating stage to create an alternating electric field to provide bunched ions to the first accelerating stage along the path.

18. The ion accelerator of claim 15, wherein the first and second variable frequency RF systems are operable to fix relative phasing between the alternative potentials in the first and second accelerating stages.

19. The ion accelerator of claim 15, wherein the first and second variable frequency RF systems are operable to adjust the relative phasing between the alternative potentials in the first and second accelerating stages.

20. The ion accelerator of claim 15, wherein the first and second variable frequency RF systems are adjustable to provide alternating potentials in a frequency range between a first frequency and about ten times the first frequency.

21. The ion accelerator of claim 15, wherein the first and second variable frequency RF systems each comprise a variable frequency RF power source and a variable frequency resonator, wherein the variable frequency RF power source and the variable frequency resonator are each adjustable between about 4 MHz and about 40 MHz.

22. An ion implantation system comprising:

an ion source operable to direct charged ions having an initial energy along a path;

an ion accelerator for accelerating the charged ions from the initial energy to a second energy along the path, the ion accelerator comprising:

a first accelerating stage comprising a first series of energizable electrodes spaced from one another along the path, each energizable electrode being spaced from an adjacent energizable electrode in a direction parallel with the path; and a first variable frequency RF power source and a first variable frequency RE resonator comprising a first terminal electrically connected with every other energizable electrode in the first series and a second terminal electrically connected with remaining electrodes in the first series, the first variable frequency RF power source operable to apply alternating potentials of a controlled frequency and amplitude to the first and second terminals, the alternating potentials at the first and second terminals being out of phase with one another;

an end station operable to position a workpiece so that charged ions accelerated to the second energy impact the workpiece; and a controller operatively connected with the variable frequency RE power source to control the frequency and amplitude of the alternating potential.

23. The ion implantation system of claim 22, further comprising a variable frequency ion buncher stage located upstream of the first accelerating stage along the path, and operable to provide bunched ions to the first accelerating stage along the path.

24. The ion implantation system of claim 23, wherein variable frequency ion buncher stage comprises an energizable electrode located upstream of the first accelerating stage along the path and a variable frequency buncher RF system operable to energize the energizable electrode of the ion buncher stage at a controlled frequency corresponding to the frequency of the first accelerating stage and a controlled phase with respect to the first accelerating stage to create an alternating electric field to provide bunched ions to the first accelerating stage along the path.

25. An ion implantation system comprising:

an ion source operable to direct charged ions having an initial energy along a path;

an ion accelerator for accelerating the charged ions from the initial energy to a second energy along the path, the ion accelerator comprising:

a first accelerating stage comprising:

a first energizable electrode along the path; and two or more constant potential electrodes arranged along the path with a first constant potential electrode located upstream of the energizable electrode, and a second constant potential electrode located downstream of the energizable electrode, wherein the constant potential electrodes are spaced from the energizable electrode to define accelerating gaps therebetween;

a first variable frequency RF system electrically connected with the energizable electrode and operable to apply an alternating potential of a controlled frequency and amplitude to create alternating electric fields in the accelerating gaps in a controlled fashion in order to accelerate ions through the first accelerating stage along the path; and a second accelerating stage comprising:

a second energizable electrode along the path; and two or more constant potential electrodes spaced from the energizable electrode along the path to define accelerating gaps therebetween; and a second variable frequency RF system electrically connected with the second energizable electrode and operable to apply an alternating potential of a controlled amplitude and a controlled frequency corresponding to a harmonic of the frequency of the first accelerating stage to create alternating electric fields in the accelerating gaps in a controlled fashion;

an end station operable to position a workpiece so that charged ions accelerated to the second energy impact the workpiece; and a controller operatively connected with the variable frequency RF system to control the frequency and amplitude of the alternating potential.

26. A method of accelerating ions traveling along a path in an ion implantation system, comprising:

providing a plurality of energizable electrodes spaced from one another in series along the path to define a plurality of accelerating gaps therebetween; and creating a plurality of alternating electric fields in the plurality of accelerating gaps using a variable frequency RF system electrically connected with the plurality of energizable electrodes.

27. The method of claim 26, wherein creating the plurality of alternating electric fields comprises applying an alternating potential of a controlled frequency and amplitude to the plurality of energizable electrodes using a variable frequency RF power source and a variable frequency resonator electrically connected with the plurality of energizable electrodes.

28. The method of claim 27, further comprising:

bunching ions from a generally DC ion beam using an ion buncher; and providing bunched ions from the ion buncher to the plurality of energizable electrodes along the path.

29. The method of claim 27, further comprising adjusting the frequency of the variable frequency RF power source in a frequency range, wherein the frequency range includes a first frequency and frequencies of between about one and ten times the first frequency.

* * * * *

UNITED STATES PATENT AND TRADEMARK OFFICE

CERTIFICATE OF CORRECTION

PATENT NO. : 6,653,643 B2
DATED : November 25, 2003
INVENTOR(S) : Kourosh Saadatmand and William F. DiVergilio It is certified that error appears in the above-identified patent and that said Letters Patent is hereby corrected as shown below:

Column 14,
Lines 60 and 61, please replace the letters "RE" with the letters -- RF -- .

Column 16,
Line 20, please replace the letters "RE" with the letters -- RF -- .

Column 17,
Line 55, please replace the letters "RE" with the letters -- RF -- .

Column 18,
Line 2, please replace the letters "RE" with the letters -- RF -- .

Signed and Sealed this

Third Day of February, 2004

JON W. DUDAS
*Acting Director of the United States Patent and Trademark Office*